US008430742B1

(12) United States Patent
Okada

(10) Patent No.: US 8,430,742 B1
(45) Date of Patent: Apr. 30, 2013

(54) GAMING MACHINE AND RECORDING MEDIUM

(75) Inventor: Kazuo Okada, Tokyo (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 0 days.

(21) Appl. No.: 13/326,916

(22) Filed: Dec. 15, 2011

(51) Int. Cl.
*A63F 9/24* (2006.01)

(52) U.S. Cl.
USPC ..... 463/20; 463/16; 463/43; 273/138.1

(58) Field of Classification Search ..... 463/16–22, 463/40–43; 273/138.1, 139, 138.2
See application file for complete search history.

(56) References Cited

U.S. PATENT DOCUMENTS

| | | | | |
|---|---|---|---|---|
| 4,448,419 | A | 5/1984 | Telnaes | |
| 6,726,563 | B1 * | 4/2004 | Baerlocher et al. | 463/25 |
| 2007/0232389 | A1 * | 10/2007 | Sato | 463/25 |
| 2008/0096655 | A1 | 4/2008 | Rasmussen et al. | |
| 2009/0124334 | A1 * | 5/2009 | Jones et al. | 463/20 |
| 2012/0231869 | A1 * | 9/2012 | Englman et al. | 463/20 |

FOREIGN PATENT DOCUMENTS

| | | |
|---|---|---|
| EP | 0122138 B1 | 10/1984 |
| JP | 59-186580 | 10/1984 |
| JP | 2011-005294 | 1/2011 |

* cited by examiner

*Primary Examiner* — Dmitry Suhol
*Assistant Examiner* — Alex F. R. P. Rada, II
(74) *Attorney, Agent, or Firm* — Lexyoume IP Meister, PLLC.

(57) ABSTRACT

A gaming machine including a display, an operating unit, and a controller is provided. The display displays a plurality of symbols in a base game to display a bonus game image in a bonus game, and displays an award according to a game result. The operating unit accepts an operation of a player. The controller executes the base game, awards a payout according to a game result of the base game to the player, triggers the bonus game including a plurality of unit games when a combination of the symbols in the base game satisfies a predetermined condition, selects any one mode for each unit game among a plurality of modes including an automatic mode and a technical mode of each unit game, executes each unit game in a corresponding selected mode, and awards a payout according to a game result of the bonus game to the player.

17 Claims, 21 Drawing Sheets

SCHEDULE TABLE FOR MODE SELECTION AT MORNING STATE

| UNIT GAME NO. | ALLOCATED MODE |
|---|---|
| 0 | AUTOMATIC MODE |
| 1 | AUTOMATIC MODE |
| 2 | AUTOMATIC MODE |
| 3 | TECHNICAL MODE |
| 4 | AUTOMATIC MODE |
| 5 | AUTOMATIC MODE |
| 6 | AUTOMATIC MODE |
| 7 | AUTOMATIC MODE |
| 8 | AUTOMATIC MODE |
| 9 | AUTOMATIC MODE |

SYMBOL TABLE FOR BASE GAME

| | | COLUMN 1 ( L1) | COLUMN 2 ( L2) | COLUMN 3 ( L3) | COLUMN 4 ( L4) | COLUMN 5 ( L5) |
|---|---|---|---|---|---|---|
| CODE NO | RANDOM NUMBER | SYMBOL | SYMBOL | SYMBOL | SYMBOL | SYMBOL |
| 0 | 0-3277 | J | SECIAL SYMBOL | A | Q | J |
| 1 | 3278-6555 | Q | A | J | J | A |
| 2 | 6556-9833 | ANGELFISH | Q | ANGELFISH | ANGELFISH | ANGELFISH |
| 3 | 9834-13111 | J | CLOWNFISH | TUNA | Q | J |
| 4 | 13112-16389 | Q | TUNA | COELACANTH | K | A |
| 5 | 16390-19667 | COELACANTH | SECIAL SYMBOL | ANGELFISH | ANGELFISH | ANGELFISH |
| 6 | 19668-22945 | A | ANGELFISH | SECIAL SYMBOL | A | COELACANTH |
| 7 | 22946-26223 | CLOWNFISH | CLOWNFISH | A | K | SECIAL SYMBOL |
| 8 | 26224-29501 | TUNA | K | J | CLOWNFISH | K |
| 9 | 29502-32779 | CLOWNFISH | COELACANTH | CLOWNFISH | Q | CLOWNFISH |
| 10 | 32780-36057 | A | SECIAL SYMBOL | A | CLOWNFISH | Q |
| 11 | 36058-39335 | Q | A | Q | TUNA | ANGELFISH |
| 12 | 39336-42613 | TUNA | CLOWNFISH | CLOWNFISH | SECIAL SYMBOL | K |
| 13 | 42614-45891 | COELACANTH | CLOWNFISH | K | K | CLOWNFISH |
| 14 | 45892-49169 | K | J | ANGELFISH | TUNA | TUNA |
| 15 | 49170-52447 | A | TUNA | Q | CLOWNFISH | J |
| 16 | 52448-55725 | CLOWNFISH | TUNA | SECIAL SYMBOL | A | SECIAL SYMBOL |
| 17 | 55726-59003 | J | ANGELFISH | A | CLOWNFISH | CLOWNFISH |
| 18 | 59004-62281 | Q | SECIAL SYMBOL | CLOWNFISH | ANGELFISH | TUNA |
| 19 | 62282-65535 | ANGELFISH | SECIAL SYMBOL | TUNA | COELACANTH | Q |

FIG. 6

RANGE OF RANDOM NUMBERS:0-65535

UNIT PAYOUT AMOUNT TABLE

| BONUS TYPE | UNIT PAYOUT AMOUNT |
|---|---|
| BLUE MARLIN | 10000 |
| BLUEFIN TUNA | 5000 |
| DOLPHIN | 4000 |
| NAPOLEON FISH | 3000 |
| YELLOWFIN TUNA | 2000 |
| ACANTHOCYBIUM SOLANDRI | 1500 |
| BLACK SEA BASS | 1500 |
| HIPPOGLOSSUS STENOLEPIS | 1000 |
| . . . | . . . |

FIG. 9

PROBABILITY TABLE FOR BONUS GAME OF TECHNICAL MODE

| RANDOM NUMBER | WINNING AWARD TYPE |
|---|---|
| 0-9 | BLUE MARLIN |
| 10-19 | BLUEFIN TUNA |
| 19-22 | DOLPHIN |
| 23-25 | NAPOLEON FISH, BLACK SEA BASS |
| 26-48 | YELLOWFIN TUNA, HIPPOGLOSSUS STENOLEPIS |
| 49-116 | ACANTHOCYBIUM SOLANDRI,BLACK SEA BASS |
| 117-210 | BLACK SEA BASS, HIPPOGLOSSUS STENOLEPIS |
| 211-293 | ACANTHOCYBIUM SOLANDRI,BLACK SEA BASS, HIPPOGLOSSUS STENOLEPIS |
| . . . | . . . |

RANGE OF RANDOM NUMBERS: 0-65535

FIG. 10

PROBABILITY TABLE OF BONUS GAME OF AUTOMATIC MODE

| RANDOM NUMBER | WINNING AWARD TYPE |
|---|---|
| 0-32767 | FAIL TO CATCH A FISH |
| 32768-32772 | BLUE MARLIN |
| 32773-32777 | BLUEFIN TUNA |
| 32778-32779 | DOLPHIN |
| 32780-32781 | NAPOLEON FISH, BLACK SEA BASS |
| 32782-32793 | YELLOWFIN TUNA, HIPPOGLOSSUS STENOLEPIS |
| 32794-32828 | ACANTHOCYBIUM SOLANDRI,BLACK SEA BASS |
| 32829-32875 | BLACK SEA BASS, HIPPOGLOSSUS STENOLEPIS |
| 32876-32916 | ACANTHOCYBIUM SOLANDRI,BLACK SEA BASS, HIPPOGLOSSUS STENOLEPIS |
| . . . | . . . |

RANGE OF RANDOM NUMBERS: 0-65535

FIG. 11

RELATIONSHIP TABLE FOR MODE SELECTION

| RANDOM NUMBER | SELECTED MODE |
|---|---|
| 0-19660 | TECHNICAL MODE |
| 19661-65535 | AUTOMATIC MODE |

RANGE OF RANDOM NUMBER: 0-65535

FIG. 12

SCHEDULE TABLE FOR MODE SELECTION

| UNIT GAME NO. | ALLOCATED MODE |
|---|---|
| 0 | TECHNICAL MODE |
| 1 | AUTOMATIC MODE |
| 2 | AUTOMATIC MODE |
| 3 | TECHNICAL MODE |
| 4 | AUTOMATIC MODE |
| 5 | AUTOMATIC MODE |
| 6 | AUTOMATIC MODE |
| 7 | TECHNICAL MODE |
| 8 | AUTOMATIC MODE |
| 9 | AUTOMATIC MODE |

FIG. 13

RELATIONSHIP TABLE FOR MODE SELECTION AT MORNING STATE

| RANDOM NUMBER | SELECTED MODE |
|---|---|
| 0-6552 | TECHNICAL MODE |
| 6553-65535 | AUTOMATIC MODE |

RANGE OF RANDOM NUMBER: 0-65535

FIG. 14A

RELATIONSHIP TABLE FOR MODE SELECTION AT AFTERNOON STATE

| RANDOM NUMBER | SELECTED MODE |
|---|---|
| 0-19660 | TECHNICAL MODE |
| 19661-65535 | AUTOMATIC MODE |

RANGE OF RANDOM NUMBER: 0-65535

FIG. 14B

SCHEDULE TABLE FOR MODE SELECTION AT MORNING STATE

| UNIT GAME NO. | ALLOCATED MODE |
|---|---|
| 0 | AUTOMATIC MODE |
| 1 | AUTOMATIC MODE |
| 2 | AUTOMATIC MODE |
| 3 | TECHNICAL MODE |
| 4 | AUTOMATIC MODE |
| 5 | AUTOMATIC MODE |
| 6 | AUTOMATIC MODE |
| 7 | AUTOMATIC MODE |
| 8 | AUTOMATIC MODE |
| 9 | AUTOMATIC MODE |

FIG. 15A

SCHEDULE TABLE FOR MODE SELECTION AT AFTERNOON STATE

| UNIT GAME NO. | ALLOCATED MODE |
|---|---|
| 0 | TECHNICAL MODE |
| 1 | AUTOMATIC MODE |
| 2 | AUTOMATIC MODE |
| 3 | TECHNICAL MODE |
| 4 | AUTOMATIC MODE |
| 5 | AUTOMATIC MODE |
| 6 | AUTOMATIC MODE |
| 7 | TECHNICAL MODE |
| 8 | AUTOMATIC MODE |
| 9 | AUTOMATIC MODE |

FIG. 15B

GAMING MACHINE AND RECORDING MEDIUM

BACKGROUND (a) Field

The present invention generally relates to a gaming machine and a recording medium.

(b) Description of the Related Art

A gaming machine is provided with a display arranged with a plurality of symbols, and the symbols are rearranged in a base game. A payout is awarded to a player according to the combination of rearranged symbols, and when the combination of symbols satisfies a predetermined condition, a bonus game may be triggered. The bonus game is a free game where no coin needs to be inserted. A game result of the bonus game may be determined by the player's operation, and an additional payout may be awarded to the player when the player succeeds in the bonus game.

In this case, since the game result of the bonus game is varied according to the player's skill, an amateur player easily fails in the bonus game such that the player can lose interest in the game. In addition, since an expert player easily succeeds in the bonus game, the payout awarded to the player is increased such that a business of a game provider can be deteriorated.

SUMMARY

Aspects of the present invention provide a gaming machine and a recording medium for awarding a certain payout to a player regardless of the player's skill.

An aspect of the present invention provides a gaming machine including a display, an operating unit, and a controller. The display displays a plurality of symbols in a base game, to display a bonus game image in a bonus game, and displays an award according to a game result. The operating unit accepts an operation of a player. The controller executes the base game, awards a payout according to a game result of the base game to the player, triggers the bonus game including a plurality of unit games when a combination of the symbols in the base game satisfies a predetermined condition, selects any one mode for each unit game among a plurality of modes including an automatic mode and a technical mode of each unit game, executes each unit game in a corresponding selected mode, and awards a payout according to a game result of the bonus game to the player. The automatic mode is a mode in which the controller automatically determines a game result of the bonus game, and the technical mode is a mode in which the game result of the bonus game is determined by the operation of the player.

The controller may not notify the player of the selected mode.

The controller may randomly select any one mode for each unit game whenever each unit game is executed.

The controller may generate a random number for each unit game whenever each unit game is executed, and select any one mode for each unit game based on the random number.

The gaming machine may further include a storage device configured to store a relationship table representing a relationship between each of the plurality of modes and a range of random numbers. The controller may generate a random number for each unit game, and select any one mode for each unit game based on the random number for a corresponding unit game and the relationship table.

The controller may change a game state of the bonus game based on a parameter among a plurality of game states, and the parameter may include a number of games which the player has played or a time during which the player has played games. The range of random numbers corresponding to the technical mode for a first game state may be different from the range of random numbers corresponding to the technical mode for a second game state.

The controller may allocate any one mode to each of the plurality of unit games when the bonus game is triggered.

The gaming machine may further include a storage device configured to store a schedule table representing a relationship between the plurality of unit games and any mode allocated to each unit game. The controller may allocate any one mode to each of the plurality of unit games based on the schedule table.

The controller may change a game state of the bonus game based on a parameter among a plurality of game states, and the parameter may include a number of games that the player has played or a time during which the player has played games. A number of unit games allocated to the technical mode for a first game state may be different from a number of unit games allocated to the technical mode for a second game state.

The controller may determine a success rate of bonus games according to the technical mode based on a game history of the player, and notify the player of information for helping the player to succeed in a game according to the technical mode when the game success rate of the player is lower than a threshold.

The controller may determine a success rate of bonus games according to the technical mode based on a game history of the player, and notify the player of information for preventing the player from succeeding in a game according to the technical mode when the success rate of the player is higher than a threshold.

The controller may determine that the player succeeds in the unit game of the technical mode when the operating unit accepts the operation of the player at a proper time.

The controller may randomly determine whether the player succeeds in the unit game of the automatic mode regardless of the operation of the player.

Another aspect of the present invention provides a gaming machine including a display, an operating unit, and a controller. The display displays a plurality of symbols in a base game to display a bonus game image in a bonus game, and displays an award according to a game result. The operating unit accepts an operation of a player. The controller executes the base game, awards a payout according to a game result of the base game to the player, triggers the bonus game including a plurality of unit games when a combination of the symbols in the base game satisfies a predetermined condition, executes at least one unit game of a first mode, switches the first mode to a second mode without notifying the player of a switch, and executes at least one unit game of the second mode. The first mode is one of an automatic mode and a technical mode, and the second mode is the other of the automatic mode and the technical mode. The automatic mode is a mode in which the controller automatically determines a game result of the bonus game, and the technical mode is a mode in which the game result of the bonus game is determined by the operation of the player.

The controller may randomly select any one mode for each unit game whenever each unit game is executed, and determine whether to switch the first mode to the second mode based on the selected mode for each unit game.

The gaming machine may further include a storage device configured to store a relationship table representing a relationship between each of the plurality of modes and a range of random numbers. The controller may generate a random number for each unit game, select any one mode for each unit game based on the random number for a corresponding unit game and the relationship table, and determine whether to switch the first mode to the second mode based on the selected mode for each unit game.

The controller may allocate any one mode to each of the plurality of unit games when the bonus game is triggered, and determine whether to switch the first mode to the second mode based on the allocated mode for each unit game.

The gaming machine may further include a storage device configured to store a schedule table representing a relationship between the plurality of unit games and any mode allocated to each unit game. The controller may allocate any one mode to each of the plurality of unit games based on the schedule table.

Yet another aspect of the present invention provides a computer-readable recording medium storing a program to cause a computer to execute a game operating method. The method includes executing a base game, awarding a payout according to a game result of the base game to a player, triggering a bonus game including a plurality of unit games when the game result of the base game satisfies a predetermined condition, selecting any one mode for each unit game among a plurality of modes including an automatic mode and a technical mode of each unit game, executing each unit game in a corresponding selected mode, and awarding a payout according to a game result of the bonus game to the player. The automatic mode is a mode in which the controller automatically determines a game result of the bonus game, and the technical mode is a mode in which the game result of the bonus game is determined by the operation of the player.

BRIEF DESCRIPTION OF THE DRAWINGS

FIG. 6 shows an example of a symbol table used when determining symbols as rearrangement objects used in a base game according to an embodiment of the present invention.

FIG. 9 shows an example of a unit payout amount table used in a bonus game according to an embodiment of the present invention.

FIG. 10 shows an example of a probability table used in a bonus game of a technical mode according to an embodiment of the present invention.

FIG. 11 shows an example of a probability table used in a bonus game of an automatic mode according to an embodiment of the present invention.

FIG. 12 shows an example of a relationship table used when selecting either a technical mode or an automatic mode.

FIG. 13 shows an example of a schedule table used when selecting either a technical mode or an automatic mode.

FIG. 14A and FIG. 14B show another example of a relationship table used when selecting either a technical mode or an automatic mode.

FIG. 15A and FIG. 15B show another example of a schedule table used when selecting either a technical mode or an automatic mode.

DETAILED DESCRIPTION

Figure 1:
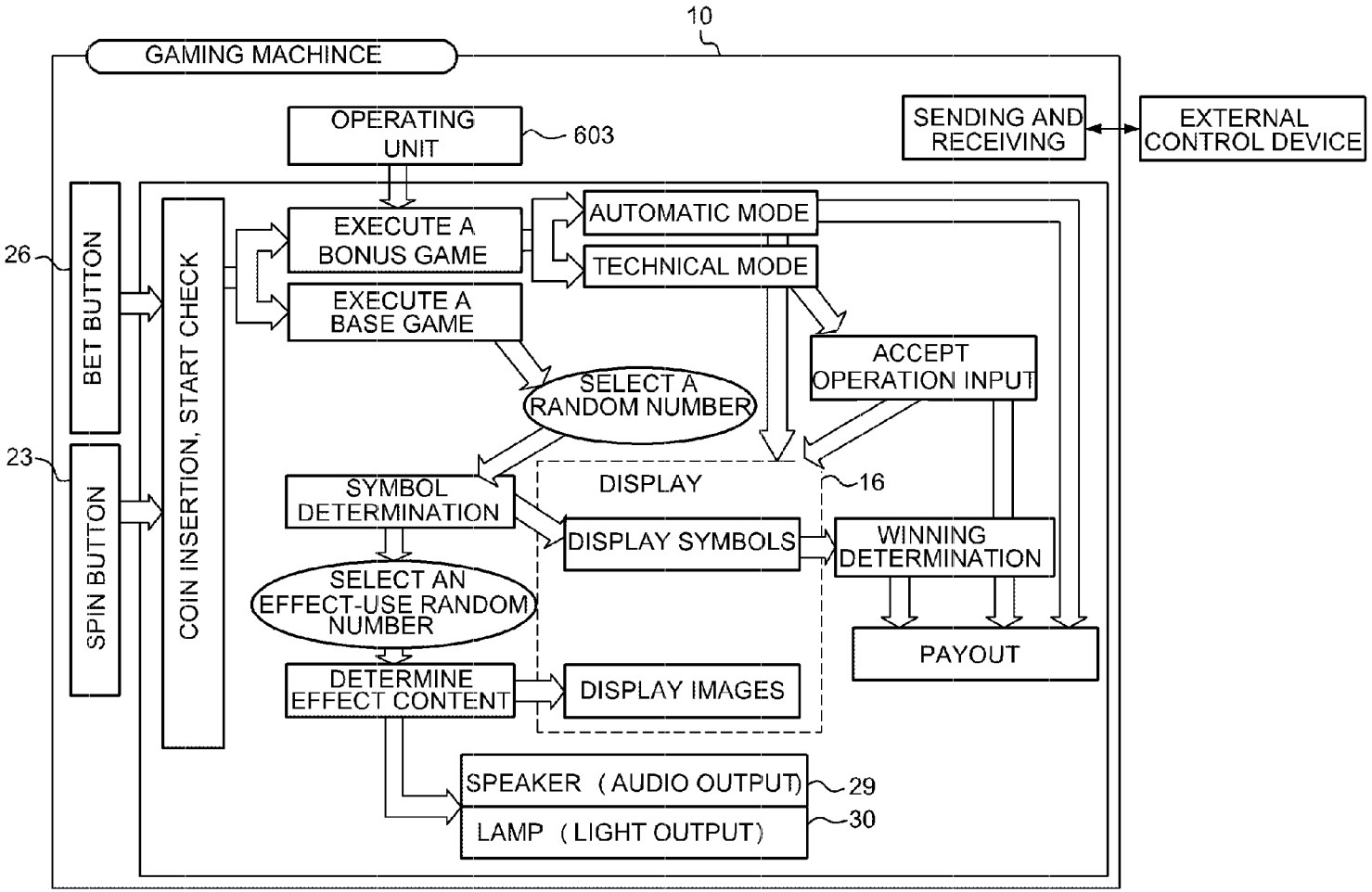
FIG. 1 is a functional flowchart of a gaming machine according to an embodiment of the present invention.

In the following detailed description, only certain embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

A gaming machine according to embodiments of the present invention is described in detail with reference to the accompanying drawings.

FIG. 1 is a functional flowchart of a gaming machine according to an embodiment of the present invention.

Referring to FIG. 1, the gaming machine 10 performs various functions that include a start check, symbol determination, symbol display, winning determination, and payout.

First, the gaming machine 10, as a start condition of a base game, checks whether a BET button 26 is pushed by a player, and then checks whether a spin button 23 is pushed by the player.

When the spin button 23 is pushed by the player, the gaming machine 10 selects random numbers for symbol determination, and determines symbols to be displayed based on the random numbers when scrolling of a symbol sequence corresponding to each of a plurality of video reels displayed on a display 16 is stopped.

The gaming machine 10 enables the symbol sequence of each video reel to start scrolling, and to stop scrolling, so as to display the determined symbols on the display 16.

When the symbol sequence of each video reel stops scrolling, the gaming machine 10 determines whether a combination of symbols displayed on the display 16 is a winning combination.

Next, when the combination of symbols that is a result of a base game is a winning combination, the gaming machine 10 gives a special prize (payout) corresponding to the type of combination of symbols. For example, when displaying a combination of symbols related to payout of coins, the gaming machine 10 pays out a number of coins corresponding to the combination of symbols. The payout can also be in the form of credit information equivalent to the number of coins to be paid out into an integrated circuit (IC) card in place of actual coins.

In addition, the gaming machine 10 may execute a bonus game when a predetermined condition is satisfied in the base game. The bonus game offers the player relatively good odds of awarding a payout without changing the payout ratio set in the base game. In the game, the payout is easily awarded, and the result does not change the payout ratio in the base game but instead increases the overall payout ratio of the game, including the base game and the bonus game.

If the bonus game is started, the gaming machine 10 selects any one mode of a technical mode and an automatic mode. The technical mode is a mode in which at least part of the result of the bonus game is determined by the operation of the player, and the automatic mode is a mode in which a result of the bonus game is automatically (i.e., randomly) determined regardless of the operation of the player. In the technical mode, the gaming machine 10 activates the acceptance of the operation input of an operating unit (control lever) and displays an image of the bonus game (for example, a fishing game) on the display 16, and the player can play the bonus game by watching the image of the display 16 while operating the operating unit. Subsequently, the player is awarded a payout on the basis of the operation result of the operating unit. Specifically, in the game (for example, a fishing game) displayed on the display 16 of the gaming machine 10, if the player wins the game by operating the operating unit, a payout corresponding to the result of the game is awarded to the player as the payout of the bonus game. In the automatic mode, the result of the game is determined regardless of the operation of the player although the gaming machine 10 accepts the operation input of the operating unit.

The gaming machine 10 may further perform effect determination. The gaming machine 10 may perform effects by displaying images on the display 16, outputting light by a lamp 30, or outputting voice through a speaker 29. The gaming machine 10 selects a random number and determines contents of the effects on the basis of the symbols determined through selection.

Next, a structure of a gaming machine 10 according to an embodiment of the present invention is described with reference to FIG. 2.

Figure 2:
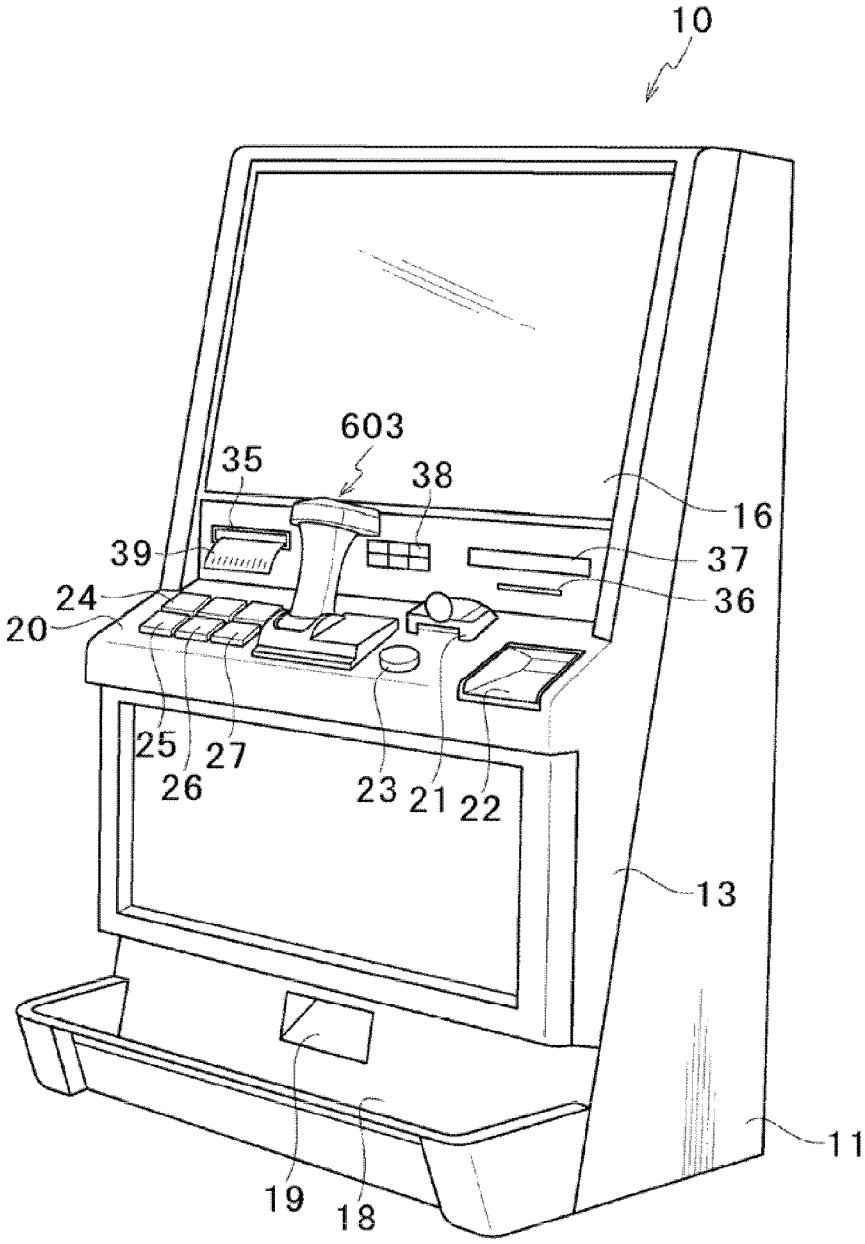
FIG. 2 is a perspective view of a gaming machine according to an embodiment of the present invention.

FIG. 2 is a perspective view of a gaming machine according to an embodiment of the present invention.

Referring to FIG. 2, the gaming machine 10 includes a cabinet 11 and a main door 13 at the front of the cabinet 11. The main door 13 is provided with a display 16. The display 16 includes a display panel for displaying a variety of information. An example of the display panel may be a liquid crystal display (LCD) panel or an organic light emitting diode (OLED) panel. The display 16 displays a display window including video reels for scroll-displaying and arranging a plurality of symbols in a base game, and displays a variety of game-related information or images as required. In addition, in a bonus game, the display 16 displays images related to the bonus game.

This embodiment also exemplifies a case where the display 16 electrically displays a plurality of symbols in 5 columns and 3 rows. However, the present invention is not limited thereto.

A credit-value display section and a payout-value display section may also be displayed in the display 16. The credit-value display section displays a total number that the gaming machine 10 can pay out to a player (which will be referred to as total credit-value). The payout-value display section displays a number of coins to be paid out when a combination of symbols stopped on the pay line is a winning combination.

A control panel 20, a coin receiving slot 21, and a bill validator 22 are provided below the display 16. The control panel 20 is provided with a plurality of buttons 23 to 27 and a control lever 603 serving as an operating unit. The buttons 23 to 27 and the control lever 603 allow instructions related to game progress to be input. The coin receiving slot 21 enables a coin to be received in the cabinet 11.

The control panel 20 is provided with a spin button 23, a change button 24, a cash out button 25, a 1-BET button 26, and a MAX-BET button 27. The spin button 23 is a button for inputting an instruction to start the scroll of symbols. The change button 24 is a button to be used when a player asks staff in the game arcade for exchange of money. The cash out button 25 is a button for inputting an instruction to pay out the coins of the total credit-value into a coin tray 18.

The 1-BET button 26 is a button for inputting an instruction to bet one coin per game from among the coins available according to the total credit-value. The MAX-BET button 27 is a button for inputting an instruction to bet a maximum number of coins per game (for example, 50 coins) from among the coins available according to the total credit-value.

The bill validator 22 validates whether a bill is genuine and receives the genuine bill in the cabinet 11. In addition, the bill validator 22 can read a ticket 39 having a barcode which will be described later. When the bill validator 22 reads the ticket 39 having a barcode, it outputs a reading signal related to the read content to a main central processing unit (CPU) 41.

A belly glass (not shown) may be provided to a lower frontal surface of the main door 13, i.e., below the control panel 20. A character of the gaming machine 10 and the like may be drawn on the belly glass.

A ticket printer 35, a card reader 36, a data display 37, and a keypad 38 are provided below the display 16. The ticket printer 35 prints, on a ticket, a barcode having encoded data containing credit-value, date and time, identification number of a gaming machine 10, or the like, and issues the ticket 39 having the barcode attached thereto. A player can play a game in another gaming machine 10 with the ticket 39 having the barcode, or exchange the ticket 39 having the barcode for bills or the like at a change booth or the like of the game arcade.

The card reader 36 reads/writes data from/to a smart card. The smart card is carried by a player, and stores therein data for identifying the player, data relating to the history of games played by the player, or the like.

The data displayer 37 includes a fluorescent display or the like, and displays the data read by the card reader 36 and the data input by the player through the keypad 38. The keypad 38 is for entering instructions or data relating to issuing of a ticket or the like.

Figure 3:
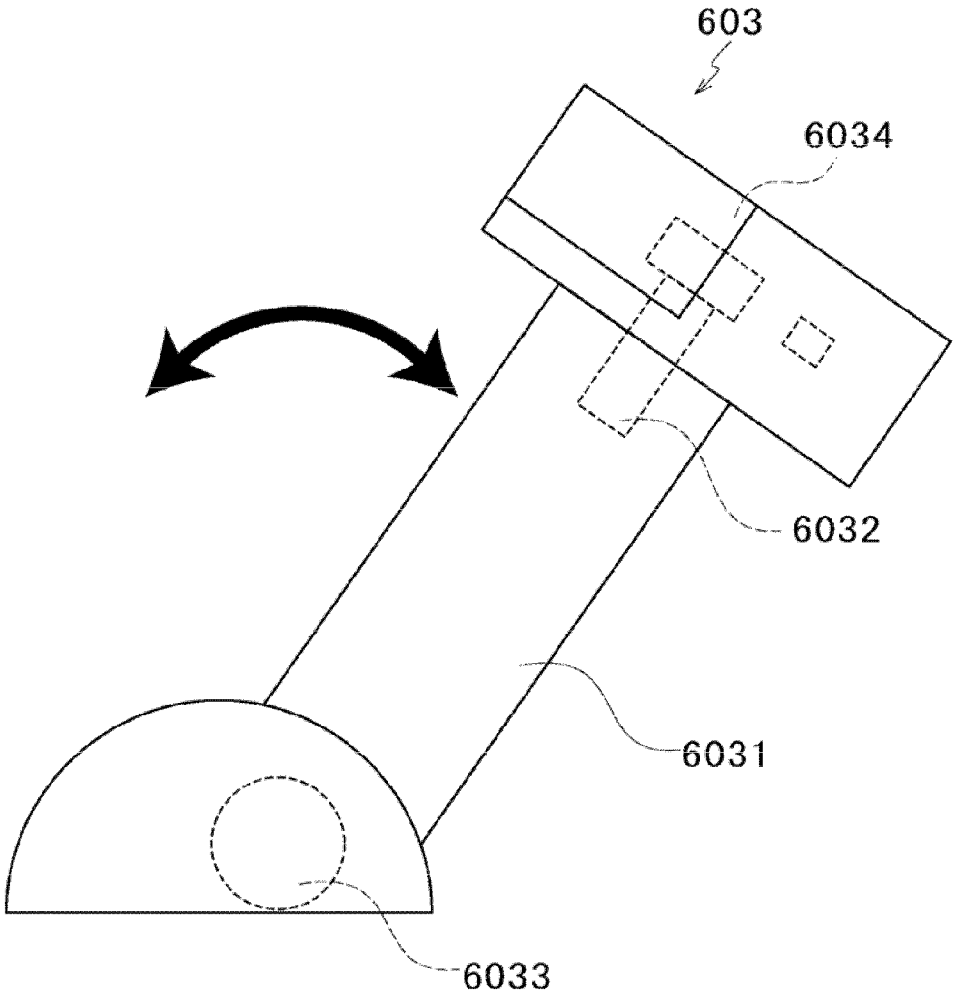
FIG. 3 is a schematic diagram of the control lever 603 observed in a horizontal direction.

FIG. 3 is a schematic diagram of the control lever 603 observed in a horizontal direction.

Referring to FIG. 3, the control lever 603 has a lever main body (lever) 6031 for a player to hold, a vibration motor (first motor) 6032 provided in the lever main body 6031 and enabling the lever to vibrate, a rotation motor 6033 provided in the lever main body 6031 and applying a force to the lever 6031 in a predetermined rotation direction, and a light emitting device such as a light emitting diode (LED) 6034 provided at an upper part of the lever main body 6031.

A cross section of the lever main body 6031 is structured to have an approximate T shape, and is provided with a light emitting portion for accommodating the LED 6034 and a holding portion to be held by the player at the upper part thereof. At the light emitting portion of the lever main body 6031, a light-transmissive cover for transmission of the light of the LED 6034 is provided. At an upper part of the holding portion, the vibration motor (not shown) may be accommodated, and the vibration motor vibrates through a driving device that is not shown. In addition, the control lever 603 can rotate in forward and backward directions when observed from the front of the gaming machine 10 (directions of the arrow in FIG. 3). At a position located in the cabinet 11 at a lower part of the holding portion of the control lever 603, the rotation motor 6033 is provided. The rotation motor 6033 imparts the rotatable control lever 603 with torque in a rotation direction through the driving device, which is not shown.

In addition, the control lever 603 may be connected to a magnet (not shown). The magnet rotates in a linked manner with the control lever 603 through the linkage with the rotation shaft rotating through the control lever 603. Accordingly, the magnet changes an external magnetic field through the rotation of the control lever 603. In addition, near the magnet, a magnetic force detecting section (not shown) is fixedly mounted. The magnetic force detecting section is provided with a magnetic force sensor for outputting a magnetic force detection signal of an output intensity corresponding to a magnetic force, and a sensor fixing section for fixing the magnetic force sensor at a predetermined position. The magnetic force detecting section detects a magnetic force of a magnetic field generated by the magnet, wherein the magnetic force changes in association with the rotation of the control lever 603.

The control lever 603 is exemplified in this embodiment, but a button performing a similar function to the control lever 603 may be used as the operation unit.

Figure 4:
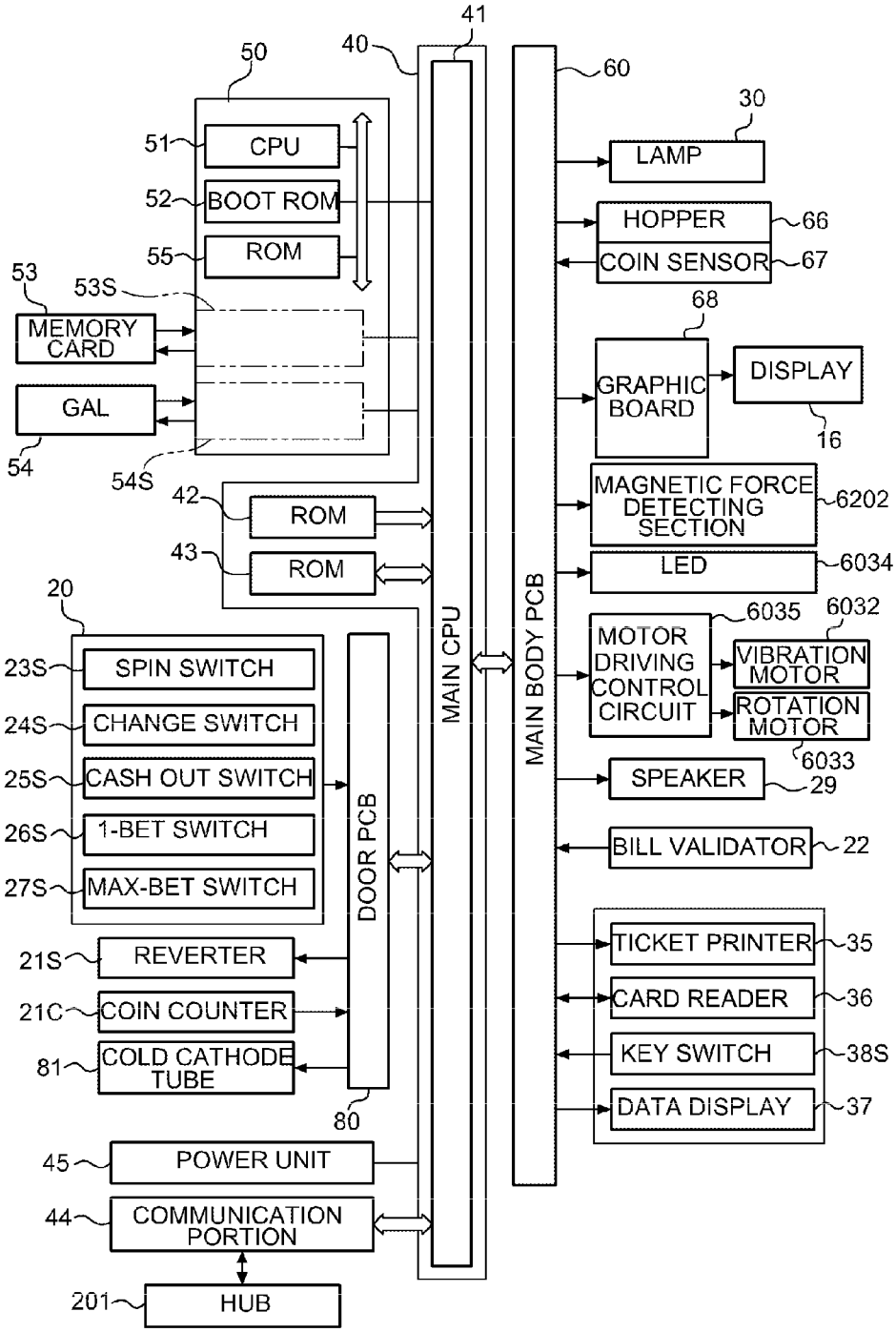
FIG. 4 is a block diagram of a gaming machine according to an embodiment of the present invention.

FIG. 4 is a block diagram of a gaming machine according to an embodiment of the present invention.

Referring to FIG. 4, a control unit including a terminal controller 630 is provided inside the cabinet 11. The control unit includes a motherboard 40, a main body print circuit board (PCB) 60, a gaming board 50, a door PCB 80, and various switches and sensors.

The gaming board 50 is provided with a CPU 51, a ROM 55, and a boot read only memory (ROM) 52 that are connected to each other by an internal bus, a card slot 53S corresponding to a memory card 53, and an IC socket 54S corresponding to a generic array logic (GAL) 54.

The memory card 53 stores a game program and a game system program. The game program includes a stop symbol determining program, which is a program for determining a symbol (code number corresponding to the symbol) to be stopped in the display window 150. The stop symbol determining program includes symbol weight data respectively corresponding to each of a plurality of payout ratios. The symbol weight data is data representing a correspondence relation between the code number of each symbol and one or more random numbers belonging to a predetermined numerical range (0 to 256) for each of the video reels.

The payout ratio is determined on the basis of data for setting a payout ratio, said data is output from the GAL 54, and a stop symbol is determined on the basis of the symbol weight data corresponding to the payout ratio.

Further, the memory card 53 stores various data used for the game program and the game system program. For example, the data representing a relationship between the symbols 501 displayed in the video reels 151 to 155 and the range of random numbers is stored in table form. In addition, the data is transmitted to a random access memory (RAM) 43 of the motherboard 40 when executing the game program.

In addition, the card slot 53S is structured to allow insertion and removal of the memory card 53 and is connected to the motherboard 40 through an integrated drive electronics (IDE) bus. Accordingly, it is possible to change the type or content of a game to be executed in the gaming machine 10 by removing the memory card 53 from the card slot 53S, writing another game program and game system program in the memory card 53, and inserting the memory card 53 into the card slot 53S.

The game program includes a program related to game progress and a program for shifting the gaming state into a bonus game. In addition, the game program includes image data or voice data to be output during the game.

The GAL 54 is provided with a plurality of input and output ports. When the data are input into the input ports, the GAL 54 outputs corresponding data from the output ports. The data output from the output ports are data for setting the payout ratio mentioned above. In addition, in this embodiment, the data for setting the payout ratio set in the base game is set to be fixed to any one of the above values (for example, 80%, 84%, and 88%), i.e., even when a bonus game is executed, the data for setting the payout ratio (the data for setting the payout ratio in the base game) is not changed. That is, the payout ratio set in the base game is not changed; instead, the payout ratio is changed by the bonus game as a result.

The IC socket 54S is structured to allow the GAL 54 to be attached and detached. The IC socket 54S is connected to the motherboard 40 through a peripheral component interconnect (PCI) bus. Accordingly, it is possible to change the data for setting the payout ratio output from the GAL 54 by detaching the GAL 54 from the IC socket 54S, rewriting the program stored in the GAL 54, and then attaching the GAL 54 to the IC socket 54S.

The CPU 51, the ROM 55, and the boot ROM 52, which are connected to each other by the internal bus, are connected to the motherboard 40 through the PCI bus. The PCI bus carries out signal transfer between the motherboard 40 and the gaming board 50, and supplies power to the gaming board 50 from the motherboard 40. The ROM 55 stores nation identification information and an authentication program. The boot ROM 52 stores a preliminary authentication program and a program (boot code) enabling the CPU 51 to execute the preliminary authentication program.

The authentication program is a program (falsification check program) for authenticating the game program and the game system program. The authentication program is a program for confirming and verifying that the game program and the game system program are not falsified. In other words, the authentication program is written following a procedure for authenticating the game program and the game system program. The preliminary authentication program is a program for authenticating the authentication program. The preliminary authentication program is written following a procedure for verifying that the authentication program to be authenticated is not falsified, i.e., for authenticating the authentication program.

The motherboard 40 is provided with the main CPU 41 (terminal controller 630), a ROM 42, the RAM 43, and a communication portion 44.

The main CPU 41 has functionality as a terminal controller 630 for controlling the whole gaming machine 10. In particular, the main CPU 41 carries out control for outputting an instruction signal to scroll the symbols 501 to a graphics board 68 when the spin button 23 is pushed after the credit is bet, control for determining symbols 501 to be stopped after the symbols 501 are scrolled, and control for stopping the determined symbols 501 in the video reels 151 to 155.

In other words, the main CPU 41 has functions as an arrangement controller for selecting and determining the arrangement of symbols with regard to a symbol matrix from the plurality of types of symbols so as to rearrange them as a new symbol matrix after scrolling the plurality of symbols to be displayed on the display 16, and executing arrangement control that will stop the determined symbols from the scroll state.

The ROM 42 stores a program such as a basic input/output system (BIOS) executed by the main CPU 41, and stores data that are permanently used. When the BIOS is executed by the main CPU 41, each of peripheral devices is initialized and the game program and the game system program stored in the memory card 53 are read out through the gaming board 50. The RAM 43 stores the data or program that is used when the main CPU 41 carries out a process.

The communication portion 44 is provided to communicate with a host computer and the like through a communication line, which is mounted in the game arcade. In addition, the communication portion 44 may be provided to communicate with a central controller (not shown) through a hub 201 and the communication line, and the motherboard 40 is respectively connected to the main body PCB 60 and the door PCB 80 through a universal serial bus (USB). Further, the motherboard 40 is connected to a power section 45. When power is supplied to the motherboard 40 from the power section 45, the main CPU 41 of the motherboard 40 is operated, and the power is supplied to the gaming board 50 through the PCI bus so that the CPU 51 can operate.

The main body PCB 60 and the door PCB 80 are connected to an apparatus or a device for producing an input signal that will be input to the main CPU 41, and an apparatus or a device that is controlled by the control signal output from the main CPU 41. The main CPU 41 executes the game program and the game system program stored in the RAM 43 based on the input signal input to the main CPU 41 to carry out an arithmetic process, and stores a result thereof in the RAM 43 or transmits a control signal to each apparatus or device to control it.

The main body PCB 60 is connected with the lamp 30, a hopper 66, a coin sensor 67, the graphics board 68, the speaker 29, the bill validator 22, the ticket printer 35, the card reader 36, a key switch 38S, and the data display 37.

The lamp 30 is turned on/off on the basis of the control signal output from the main CPU 41.

The hopper 66 is mounted in the cabinet 11 and pays out a predetermined number of coins to the coin tray 18 from the coin payout slot 19 based on the control signal output from the main CPU 41. The coin sensor 67 is mounted in the coin payout slot 19 and outputs an input signal to the main CPU 41 when it detects that the predetermined number of coins are paid out from the coin payout slot 19.

The graphics board 68 controls image display in the display 16 based on the control signal outputted from the main CPU 41. In addition, the graphics board 68 is provided with a video display processor (VDP) for producing image data on the basis of the control signal output from the main CPU 41, a video RAM for temporarily storing the image data produced by the VDP, and the like. In addition, the image data used when the VDP produces the image data is included in the game program that is read from the memory card 53 and stored in the RAM 43.

The bill validator 22 reads an image of the bill and receives a genuine bill in the cabinet 11. In addition, when receiving the genuine bill, the bill validator 22 outputs an input signal to the main CPU 41 based on the amount of the bill. The main CPU 41 stores a credit-value that corresponds to the amount of the bill transmitted by the input signal in the RAM 43.

The ticket printer 35 prints a barcode having data encoded thereto, such as credit-value stored in the RAM 43, date and time, identification number of the gaming machine 10, and the like, on a ticket, based on the control signal output from the main CPU 41, and outputs the ticket 39 having the barcode.

The card reader 36 reads the data from the smart card and transmits it to the main CPU 41, or writes the data onto the smart card, based on the control signal output from the main CPU 41. The key switch 38S is mounted to the keypad 38, and outputs an input signal to the main CPU 41 when the player manipulates the keypad 38. The data display 37 displays the data that is read by the card reader 36 or the data which the player inputs through the keypad 38, based on the control signal output from the main CPU 41.

The door PCB 80 is connected with the control panel 20, a reverter 21S, a coin counter 21C, and a cold cathode tube 81. The control panel 20 is provided with a spin switch 23S corresponding to the spin button 23, a change switch 24S corresponding to the change button 24, a cash out switch 25S corresponding to the cash out button 25, a 1-BET switch 26S corresponding to the 1-BET button 26, and a MAX-BET switch 27S corresponding to the MAX-BET button 27. Each of the switches 235 to 27S outputs an input signal to the main CPU 41 when each of the corresponding buttons 23 to 27 is pushed by a player.

The coin counter 21C is mounted in the coin receiving slot 21 and validates whether a coin inserted in the coin receiving slot 21 by the player is genuine. Any non-genuine coin is discharged from the coin payout slot 19. In addition, the coin counter 21C outputs an input signal to the main CPU 41 when it detects a genuine coin.

The reverter 21S is operated on the basis of the control signal output from the main CPU 41 and distributes a coin, which is recognized as a genuine coin by the coin counter 21C, to a cash box (not shown) or hopper 66 mounted in the gaming machine 10. In other words, when the hopper 66 is fully filled with coins, the genuine coin is deposited into the cash box by the reverter 21S, and when the hopper 66 is not fully filled with coins, the genuine coin is deposited into the hopper 66. The cold cathode tube 81 functions as a backlight mounted to rear sides of the display 16 and an upper image display panel, and is turned on based on the control signal output from the main CPU 41.

In addition, the main body PCB 60 is connected with a motor driving control circuit 6035. The motor driving control circuit 6035 controls driving of the vibration motor 6032 and the rotation motor 6033. In addition, the main body PCB 60 is connected with the LED 6034, it controls light emission of the LED 6034, and is connected with a magnetic force detecting section 6202. As described above, the magnetic force detecting section 6202 is for detecting a magnetic force representing a position of the control lever 603, and transmitting a magnetic force signal to the main body PCB 60.

Next, a base game independently executed in a gaming machine according to an embodiment of the present invention is described with reference to FIG. 5 and FIG. 6.

Figure 5:
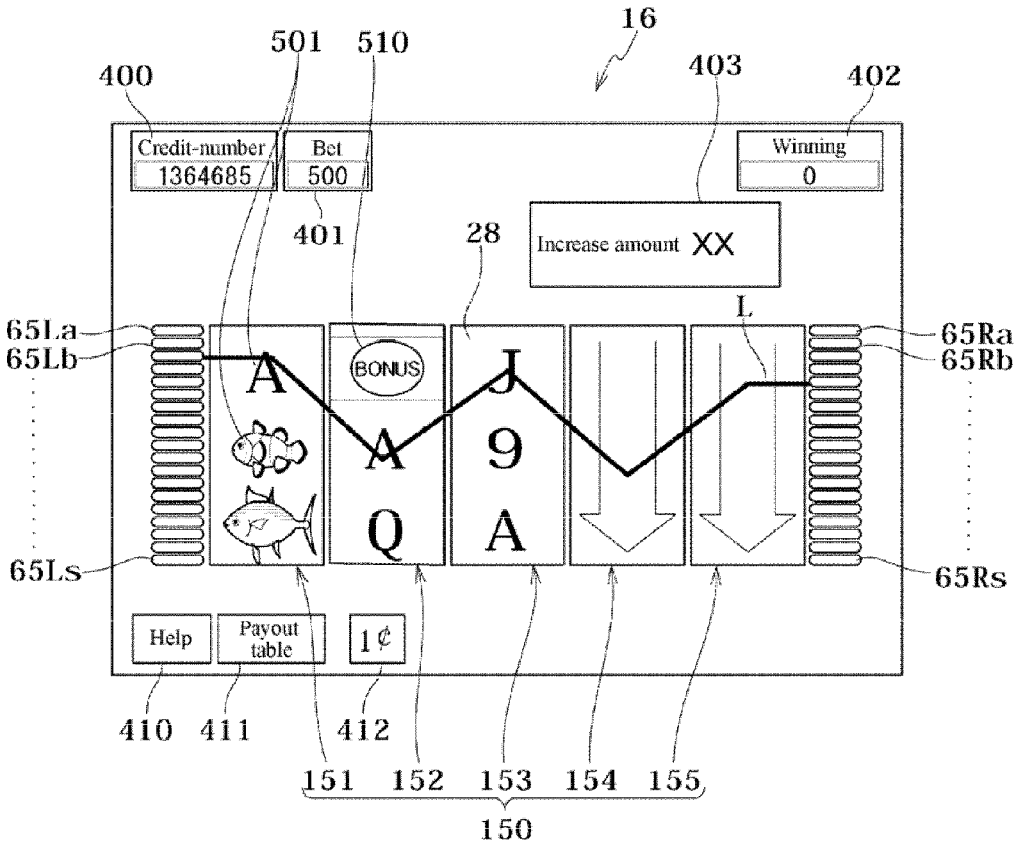
FIG. 5 shows an example of a display picture of a base game according to an embodiment of the present invention.

FIG. 5 shows an example of a display picture of a base game according to an embodiment of the present invention, and FIG. 6 shows an example of a symbol table used when determining symbols as rearrangement objects used in a base game according to an embodiment of the present invention.

Referring to FIG. 5, a display window 150 including video reels 151 to 155 is displayed in the display 16. The display window 150 includes fifteen (15) display blocks 28 in five (5) columns and three (3) rows. In other words, each of the video reels 151 to 155 includes three (3) display blocks 28. A plurality of symbols 501 are displayed on the video reels 151 to 155 for displaying the base game, and are formed into symbol sequences. Each of the video reels 151 to 155 can enable 3 display blocks 28 to integrally change speed while moving downward to be displayed (scroll-displayed), so as to carry out the rearrangement that stops the symbols 501 displayed in each display block 28 after spinning the symbols 501 in a vertical direction.

Pay line generation columns are symmetrically arranged at the left side and the right side of the display window 150. The pay line generation column at the left side as observed from the side of the player, as shown in FIG. 5, and includes a plurality of pay line generation portions, for example nineteen (19) pay line generation portions 65L (65La, 65Lb, 65Lc, 65Ld, 65Le, 65Lf, 65Lg, 65Lh, 65Li, 65Lj, 65Lk, 65L1, 65Lm, 65Ln, 65Lo, 65Lp, 65Lq, 65Lr, and 65Ls).

The pay line generation column at the right side includes a plurality of pay line generation portions, for example nineteen (19) pay line generation portions 65R (65Ra, 65Rb, 65Rc, 65Rd, 65Re, 65Rf, 65Rg, 65Rh, 65Ri, 65Rj, 65Rk, 65Rl, 65Rm, 65Rn, 65Ro, 65Rp, 65Rq, 65Rr, and 65Rs).

Each pay line generation portion 65L forms a pair with any of the pay line generation portions 65R. A pay line L from each pay line generation portion 65L to the pay line generation portion 65R having a paired relationship with the pay line generation portion 65L is predetermined. In addition, in FIG. 5, for ease of description, only one pay line L is drawn, but in this example, ten (10) pay lines L may be predetermined.

The pay line L is activated through a connection between the pay line generation portions 65L and 65R; otherwise, the pay line L is inactivated. The number of activated pay lines L is determined on the basis of the BET amount. In the case of the maximum BET amount, i.e., MAX-BET, the maximum number of pay lines L, i.e., 10 pay lines, are activated. The activated pay lines L make all winning combinations relating to the symbols 501 satisfied. Detailed description of the winning combinations is provided in the following contents.

In this embodiment, the case in which the gaming machine 10 is a video slot machine is described, but mechanical reels may replace a part of the video reels 151 to 155 in the gaming machine 10.

As shown in FIG. 6, the symbols 501 forming each symbol sequence are imparted with any code among a plurality of codes, for example codes from 0 to 19. Each symbol sequence includes a symbol combination of symbols 501 such as "Special symbols 510", "A", "Q", "J", "K", "Angelfish", "Clownfish", "Tuna", and "Coelacanth".

Referring to FIG. 5 again, 3 continuous symbols 501 in the symbol sequence are respectively displayed (arranged) at an upper part, a middle part, and a lower part of a display area of each of the video reels 151 to 155, so as to form a symbol matrix having 5 columns and 3 rows in the display window 150. If a spin button (23 of FIG. 2) is pushed to start the game, the symbols 501 forming the symbol matrix start scrolling. If a predetermined time has passed after the scrolling is started, the scrolling of all symbols 501 is stopped (rearranged).

Various winning combinations are predetermined for all symbols 501, and the winning combinations represent prize winning. The winning combination is a combination where the combination of symbols 501 stopped on the pay line L becomes a beneficial state for a player. The beneficial state is a state where coins corresponding to winning combinations are to be paid out, a state where the payout value of the coins is to be added to the credit, a state where the bonus game is to be started, or the like.

In this example, the winning combinations refer to cases where at least one type of symbol 501 among the "A", "Q", "J", "K", "BAT", "Angelfish", "Clownfish", "Tuna", and "Coelacanth" are rearranged on activated pay lines L with a number higher than the predetermined number. In addition, when the symbols 501 of the predetermined types are set to scatter symbols, the winning combinations are formed in the cases of rearrangement with a number higher than the predetermined number regardless of whether the pay lines L are activated or inactivated.

For example, in the base game, in the cases where the symbols 501 of "BAT" are stopped on the pay line L in the form of a winning combination, the payout value of coins (value) obtained by multiplying the basic payout value of "BAT" by the BET amount is paid out.

Referring to FIG. 6 again, in the symbol table, a correspondence relation is established between each symbol 501 of the display block 28 in each symbol sequence and a code No., and a correspondence relation is established between a random number range obtained by dividing a range from 0 to 65535 into 20 parts and each code No.

The division may be uniform or non-uniform. When the division is non-uniform, the winning probability according to the ranges of the random numbers may be adjusted on the basis of the types of symbols 501. In addition, the ranges corresponding to special symbols 510 may also be set to a range narrower than symbols 501 of other types. At this time, based on the conditions of the games, it is difficult to win the valuable types of symbols 501, so the winning and losing can be easily adjusted.

For example, in a first column, if a randomly selected random number is 10,000, the "J" of the code No. 3 having a correspondence relation established with a random number range including the random number becomes a rearrangement object in the video reel 151 of the first column. In addition, for example, in a fourth column, if the randomly selected random number is 40,000, the "special symbol" of the code No. 12 having a correspondence relation established with a random number range including the random number becomes a rearrangement object in the video reel 151 of the fourth column.

Referring to FIG. 5 again, a base game picture includes the display window 150 having 5 columns of video reels 151 to 155 arranged at a central part, and pay line generation portions 65L and 65R symmetrically arranged with the display window 150 as a center. In the base game picture of FIG. 5, the video reels 151, 152, and 153 in the first to third columns are in a stopped state, and the video reels 154 and 155 in the fourth and fifth columns are being scroll-displayed.

A credit-value display section 400 and a BET value display section 401 are arranged at the left side at the upper part of the terminal image display panel 16, and a payout display section 402 is arranged at the right side.

The credit-value display section 400 displays a credit-value, the BET value display section 401 displays a BET amount in a current unit game, and the payout display section 402 displays a payout value of coins at a winning combination.

In the meantime, below the display window 150, a help button 410, a payout table button 411, and a BET unit display section 412 are arranged in sequence from left to right as observed by a player.

The help button 410 can execute a help mode through a push operation of a player. The help mode is a mode for providing information to answer game-related questions for a player. The payout table button 411 can execute a payout display mode for displaying payout contents through a push operation of a player. The payout display mode is a mode for displaying an instruction picture representing a relationship between a winning combination and a payout rate to a player.

The BET unit display section 412 displays a current BET unit (payout unit). Accordingly, the BET unit display section 412 enables a player to learn that the player can join in the game with, for example, 1 cent as a unit.

Above the display window 150, a payout ratio increase amount display section 403 is arranged. The payout ratio increase amount display section 403 displays an increase amount of a payout ratio in a bonus game relative to the payout ratio in the base game (an increased amount of the obtained number of coins). Accordingly, the player can learn that a current state is more beneficial than the base game. In addition, the payout ratio increase amount display section 403 also displays in the picture of the base game of the display 16 as shown in FIG. 5, and also displays in the picture of executing the bonus game (the picture of the display 16).

Next, a bonus game triggered when a predetermined condition is satisfied in a base game is described with reference to FIG. 7 to FIG. 11.

Figure 7:
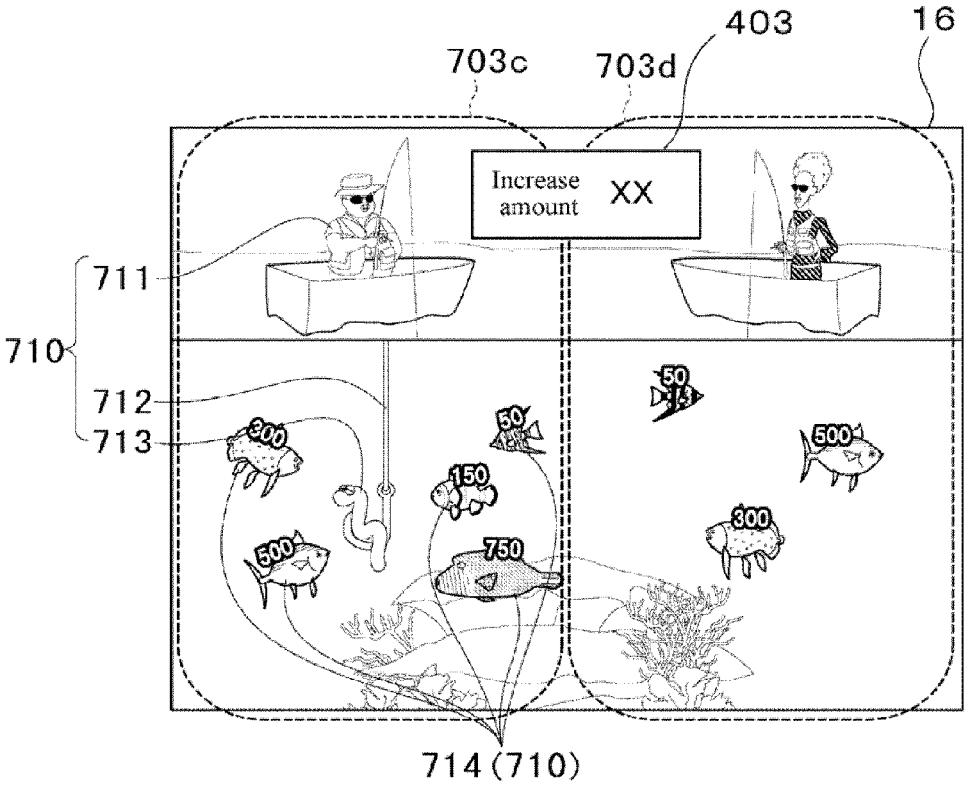
FIG. 7 and FIG. 8 show examples of pictures displayed in a bonus game according to an embodiment of the present invention.
Figure 8:
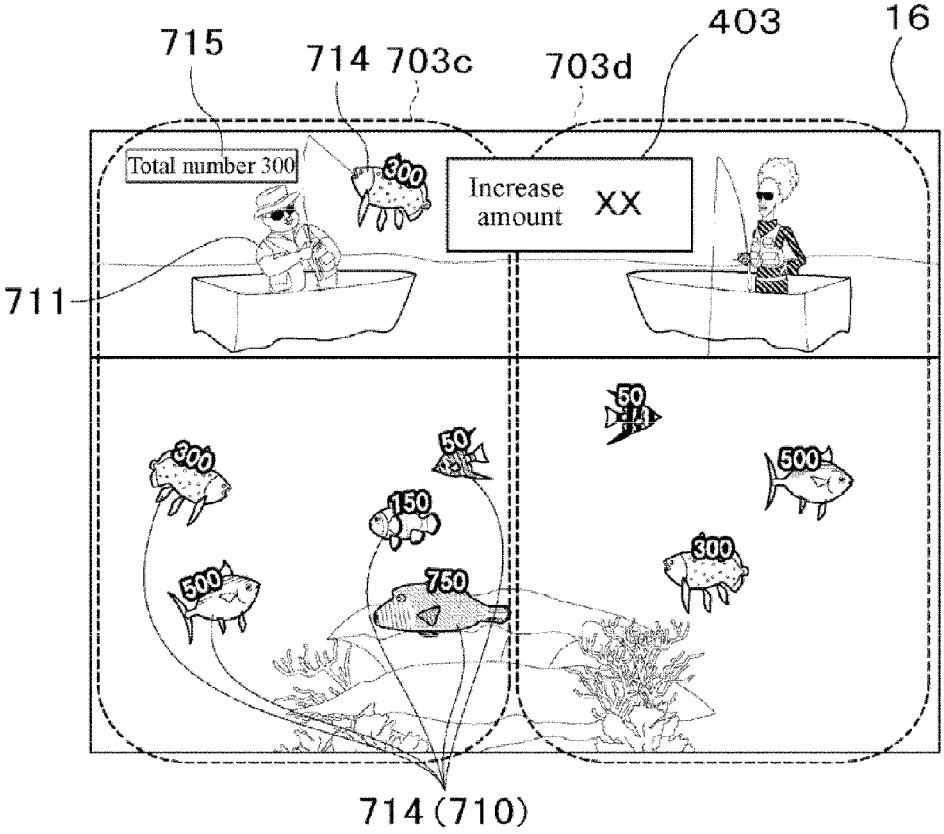

FIG. 7 and FIG. 8 show examples of pictures displayed in a bonus game according to an embodiment of the present invention. FIG. 9 shows an example of a unit payout amount table used in a bonus game according to an embodiment of the present invention, FIG. 10 shows an example of a probability table used in a bonus game of a technical mode according to an embodiment of the present invention, and FIG. 11 shows an example of a probability table used in a bonus game of an automatic mode according to an embodiment of the present invention.

Referring to FIG. 7, individual images 710 including an angler image 711, a hook image 712, a bait image 713, and a fish image 714 are displayed in a picture of the display 16. In addition, in the picture of the display 16, an image area 703*c* for displaying individual images 710 that are changed according to operations of the player and an image area 703*d* for displaying images of the fishing by an angler not operated by the player are provided. The operations may be operations on the control lever (603 of FIG. 2) by the player.

The hook image 712 is displayed by a display image that is changed with the control lever 603. The bait image 713 is displayed at the lower end portion of the hook image 712.

The fish image 714 represents a unit payout amount in the bonus game based on the size of a fish. Various fish images 714 are displayed close to the bait image 713 or swimming around the bait image 713.

In this embodiment, the bonus game is executed in a mode that is randomly selected among a technical mode and an automatic mode. The technical mode is a mode in which at least part of the result of the bonus game is determined by the operation of the player, and the automatic mode is a mode in which a result of the bonus game is automatically (i.e., randomly) determined regardless of the operation of the player.

First, in the technical mode, the player performs an operation of pulling the control lever 603 according to the movement of the fish images 714. If the operation is performed at a proper time, as shown in FIG. 8, an image in which the angler (angler image 711) catches a fish (fish image 714) is displayed.

If the result that the fish is successfully caught according to the time of the operation is obtained, a payout set in the bonus game is awarded to the player. The payout may be a number of coins. The number of coins is set to a number having a higher payout ratio than the payout ratio in the base game.

For example, as shown in FIG. 9, in the bonus game, the unit payout amount corresponding to the type of the caught fish is set in a memory, for example RAM (43 of FIG. 4). In the bonus game, on the basis of the unit payout amount table, the payout awarded to the player is determined. For example, a blue marlin corresponds to a unit payout amount of 10,000, and a black sea bass corresponds to a unit payout of 1000. The selection of one of the various fishes is determined through selection by using a probability table for the bonus game as shown in FIG. 10. Corresponding to the random numbers in the probability table, the probabilities of catching the various fishes are determined. In other words, the blue marlin having the highest payout amount has the lowest selection probability based on the distributed random number. Accordingly, the operation time of the control lever 603 for catching the blue marlin is set to a shorter time. In other words, if the player fails to operate the control lever 603 at a more accurate time, the player is unable to catch the blue marlin. In addition, a fish set with a lower probability of being selected is also set with a lower probability of being close to the hook image 712 (bait image 713). Accordingly, it is set that the probability of catching the fish becomes lower.

Next, in the automatic mode, the result of the bonus game is determined regardless of the operation of the player. Even though the player performs the operation of pulling the control lever 603 at the proper time, whether the fish is successfully caught is randomly determined. In addition, when the fish is successfully caught, the type of the caught fish may also be randomly determined.

For example, a probability table for the bonus game of the automatic mode may be set as shown in FIG. 11. Corresponding to the random numbers in the probability table, the probabilities of catching the various fishes are determined. In other words, if a random number from 0 to 32767 is generated (i.e., selected) in the gaming machine 10, the player fails to catch the fish even though the player performs the operation of pulling the control lever 603 at the proper time. If a random number from 32768 to 65535 is generated in the gaming machine 10, the player successfully catches the fish corresponding to the random number even if the player does not perform the operation of pulling the control lever 603 at the proper time. In addition, on the basis of the unit payout amount table where the unit payout amount corresponding to the type of the caught fish is set, the payout awarded to the player is determined.

In the bonus game, a selection of the technical mode and the automatic mode is randomly determined. Accordingly, switching from the technical mode to the automatic mode or switching from the automatic mode to the technical mode is also randomly performed. Further, the gaming machine 10 may not notify the player of whether the bonus game is currently executed in the technical mode or the automatic mode.

Hereinafter, a method for selecting the technical mode and the automatic mode is described with reference to FIG. 12, FIG. 13, FIG. 14A, FIG. 14B, FIG. 15A, and FIG. 15B.

FIG. 12 shows an example of a relationship table used when selecting either a technical mode or an automatic mode.

In one embodiment, whenever a bonus game is executed, the gaming machine 10, particularly a main CPU (41 of FIG. 4) of the gaming machine, generates a random number, and selects either of the technical mode and the automatic mode based on the generated random number. At this time, the gaming machine 10 may select either mode based on the data representing a relationship between the selected mode and the range of the random number as shown in FIG. 12. The data are stored to a storage device such as a memory card (53 of FIG. 4) in table form. Alternatively, whenever the base game is executed, the gaming machine 10 may generate a random number and select either of the technical mode or the automatic mode based on the generated random number. In other words, the gaming machine 10 further generates the random number for selecting either of the technical mode and the automatic mode when generating the random numbers for determining the symbols (501 of FIG. 5) displayed in the video reels (151 to 155 of FIG. 5). When a predetermined condition is satisfied in the base game, the gaming machine 10 executes the bonus game in the mode selected according to the random number.

FIG. 13 shows an example of a schedule table used when selecting either a technical mode or an automatic mode.

When the predetermined condition is satisfied in the base game, a bonus game set including a plurality of unit games may be triggered. That is, the plurality of unit games may be executed in the bonus game. The number of unit games is predetermined and is stored in a RAM (43 of FIG. 4). In this case, whenever each unit game is executed, the gaming machine 10 may generate a random number and select either of the technical mode or the automatic mode based on the generated random number and the relationship table shown in FIG. 12.

Alternatively, the gaming machine 10, particularly a main CPU (41 of FIG. 4) of the gaming machine, selects either of the technical mode and the automatic mode for each unit game based on a schedule table. In the schedule table, schedule data representing a relationship between the plurality of unit games and any mode allocated to each unit game is stored. The schedule table is stored to a storage device such as a memory card (53 of FIG. 4). For example, as shown in FIG. 13, in the schedule table for the game set including 10 unit games, the technical mode is allocated to 3 unit games and the automatic mode is allocated to 7 unit games. Then, when the bonus game is executed, the technical mode is selected with the probability of 30% and the automatic mode is selected with the probability of 70%.

FIG. 14A and FIG. 14B show another example of a relationship table used when selecting either a technical mode or an automatic mode, and FIG. 15A and FIG. 15B show another example of a schedule table used when selecting either a technical mode or an automatic mode.

In yet another embodiment, the gaming machine 10, particularly a main CPU (41 of FIG. 4) of the gaming machine, changes a relationship table representing a relationship between the selected mode and the range of random number in accordance with a game state of the bonus game. The gaming machine 10 determines the game state based on a variable parameter of the player. The parameter includes a number of games that the player has played and/or a time during which the player has played games.

In the example of the bonus game shown in FIG. 7 to FIG. 10, the state of the bonus game may be set to either a morning state representing the morning time or an afternoon state representing the afternoon time in accordance with a number of games that the player has played and/or a time during which the player has played games. For example, the state of the bonus game may be varied from the morning state to the afternoon state when the number of games that the player has played or the time during which the player has played games exceeds a threshold. In this case, the gaming machine 10 applies the different relationship tables to the morning state and the afternoon state. As shown in FIG. 14A and FIG. 14B, a numerical range of random numbers corresponding to the technical mode in the relationship table of the morning state is narrower than a numerical range of random numbers corresponding to the technical mode in the relationship table of the afternoon state. Accordingly, a probability with which the technical mode is selected in the morning state is lower than a probability with which the technical mode is selected in the afternoon state.

In yet another embodiment, the gaming machine 10 changes a schedule table where either of the technical mode and the automatic mode is allocated to each unit game of the game set, in accordance with the game state of the bonus game.

In the example of the bonus game shown in FIG. 7 to FIG. 10, the gaming machine 10 applies the different schedule tables to the morning state and the afternoon state. As shown in FIG. 15A and FIG. 15B, the technical mode is allocated to 1 unit game in the schedule table of the morning state, and the technical mode is allocated to 3 unit games in the schedule table of the afternoon state. Then, if the game state is the morning state when the bonus game is executed, the technical mode is selected with the probability of 10%. If the game state is the afternoon state when the bonus game is executed, the technical mode is selected with the probability of 30%. As described above, according to embodiments of the present invention, the payouts according to the bonus game of the technical mode and the payouts according to the bonus game of the automatic mode can be awarded to the player in the bonus game. Accordingly, even if the player is an amateur who cannot easily succeed in the bonus game of the technical mode, the payouts according to the bonus game of the automatic mode are awarded to the player such that the game machine 10 can interest the player in the game. Further, even if the player is an expert who can easily succeed in the bonus game of the technical mode, some results of the bonus game are determined in the automatic mode regardless of the game technique of the player such that a service provider of the game machine 10 can prevent his business from deteriorating.

On the other hand, if the player plays the game for a long time, the differences between the payouts awarded to the expert and the payouts awarded to the amateur can be increased. Hereinafter, a method for reducing the differences is described with reference to FIG. 16 and FIG. 17.

Figure 16:
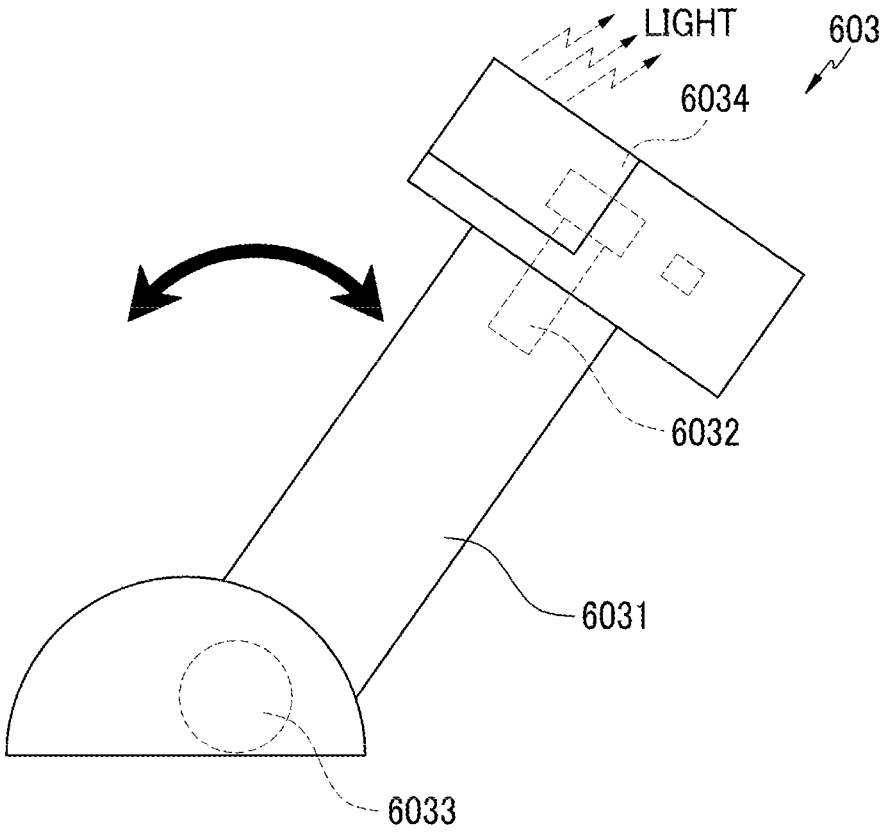
FIG. 16 and FIG. 17 are diagrams showing a notification in a bonus game according to an embodiment of the present invention.
Figure 17:
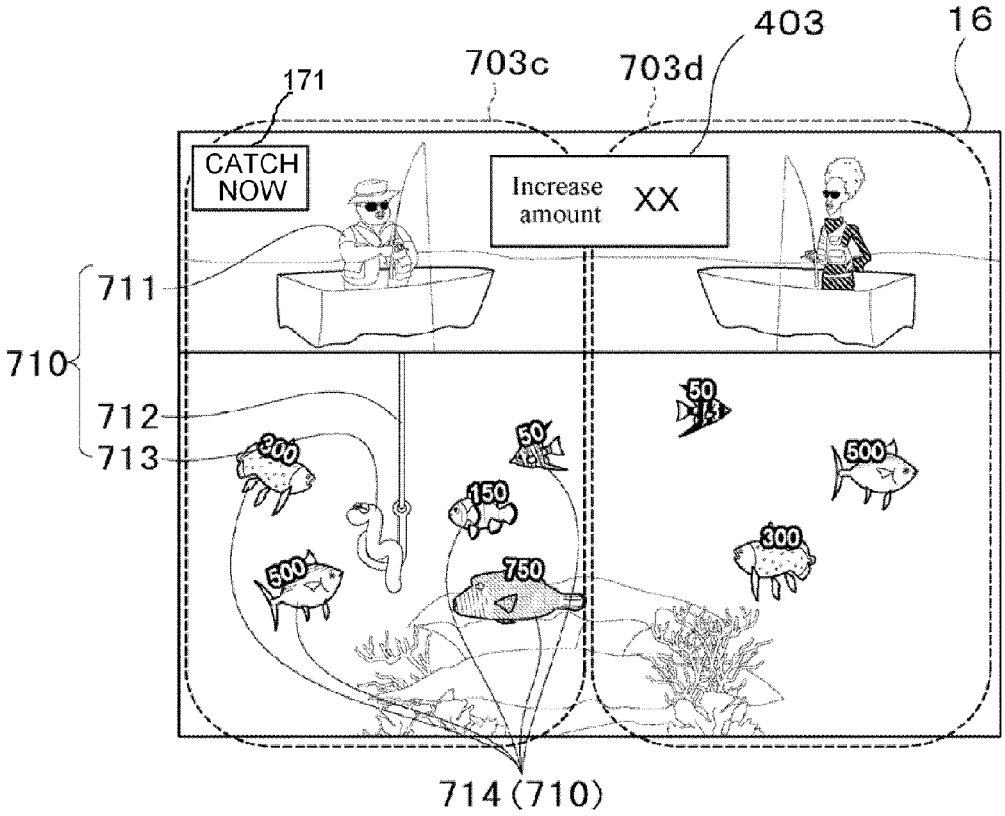

FIG. 16 and FIG. 17 are diagrams showing a notification in a bonus game according to an embodiment of the present invention.

In an embodiment, a gaming machine 10, particularly a main CPU (41 of FIG. 4) of the gaming machine 10, determines whether to notify the player of information for obtaining a good result in a game of a technical mode, based on game history information of the player that is stored to the gaming machine 10. In detail, while the player is playing the games, the game history information of the player such as payouts awarded to the player in the games of the technical mode or a success rate of the player in the games of the technical mode is stored to a storage device such as a memory card (53 of FIG. 4) or a RAM (43 or FIG. 4) of the gaming machine 10. The gaming machine 10 analyzes the game history information of the player to determine whether the player is an expert or an amateur at the game. The gaming machine 10 may determine that the player is an expert of the game when the payouts awarded to the player is greater than a threshold or the success rate of the player is higher than a threshold.

If the player is an amateur, the gaming machine 10 notifies the player of the information for helping the player to succeed in the game in the technical mode. If the player is an expert, the gaming machine 10 does not notify the player of the information or notifies the player of information for preventing the player from succeeding in the game of the technical mode.

As shown in FIG. 16, if the player is an amateur, the gaming machine 10, particularly a main CPU (41 of FIG. 4) of the gaming machine 10, controls the light emitting device of the operating unit to emit light at the time when the player can obtain a good result in the game. For example, if the player performs the operation of pulling the control lever 603 at the time when the LED 6034 of the control lever 603 emits light, the player can successfully catch the fish. However, if the player is an expert, the gaming machine 10 may control the light emitting device of the operating unit to not emit light or to emit light at the time when the player cannot obtain a good result in the game.

Alternatively, as shown in FIG. 17, the gaming machine 10, particularly the main CPU (41 of FIG. 4) of the gaming machine 10, displays a notification image 171 for indicating the time when the player can obtain a good result in the game in a display 16 if the player is an amateur. For example, if the player performs the operation of pulling the control lever 603 at the time indicated by the notification image 171, the player can successfully catch the fish. However, if the player is an expert, the notification image 171 may not be displayed in the display 16, or the notification image 171 may indicate the time when the player cannot obtain the good result in the game.

As another example, in a game for stopping a plurality of video reels that are being scrolled in a display 16 in a predetermined order, the gaming machine 10 may notify an amateur player of a stopping order by controlling the light emitting device of the operating unit to emit the light at a proper time. Alternatively, the gaming machine 10 may notify an amateur player of the stopping order by displaying an image indicating the stopping order in the display 16. The gaming machine 10 may not notify an expert player of the stopping order. Alternatively, the gaming machine 10 may notify an expert player of the stopping order at the time after at least one video reel is stopped. In this case, the game machine 10 may adjust the time by referring the game history of the player using a timer (not shown) installed in the game machine 10.

As described above, by the notification, the possibility that an amateur can obtain a good result in the bonus game in the technical mode is increased, but the possibility that an expert can obtain a good result in the bonus game of the technical mode is not changed or is decreased. Therefore, the differences between the payouts awarded to an expert and an amateur that may be generated when playing the game for the long time can be reduced.

Next, a processing operation of a gaming machine is described with reference to FIG. 18, FIG. 19, and FIG. 20.

Figure 18:
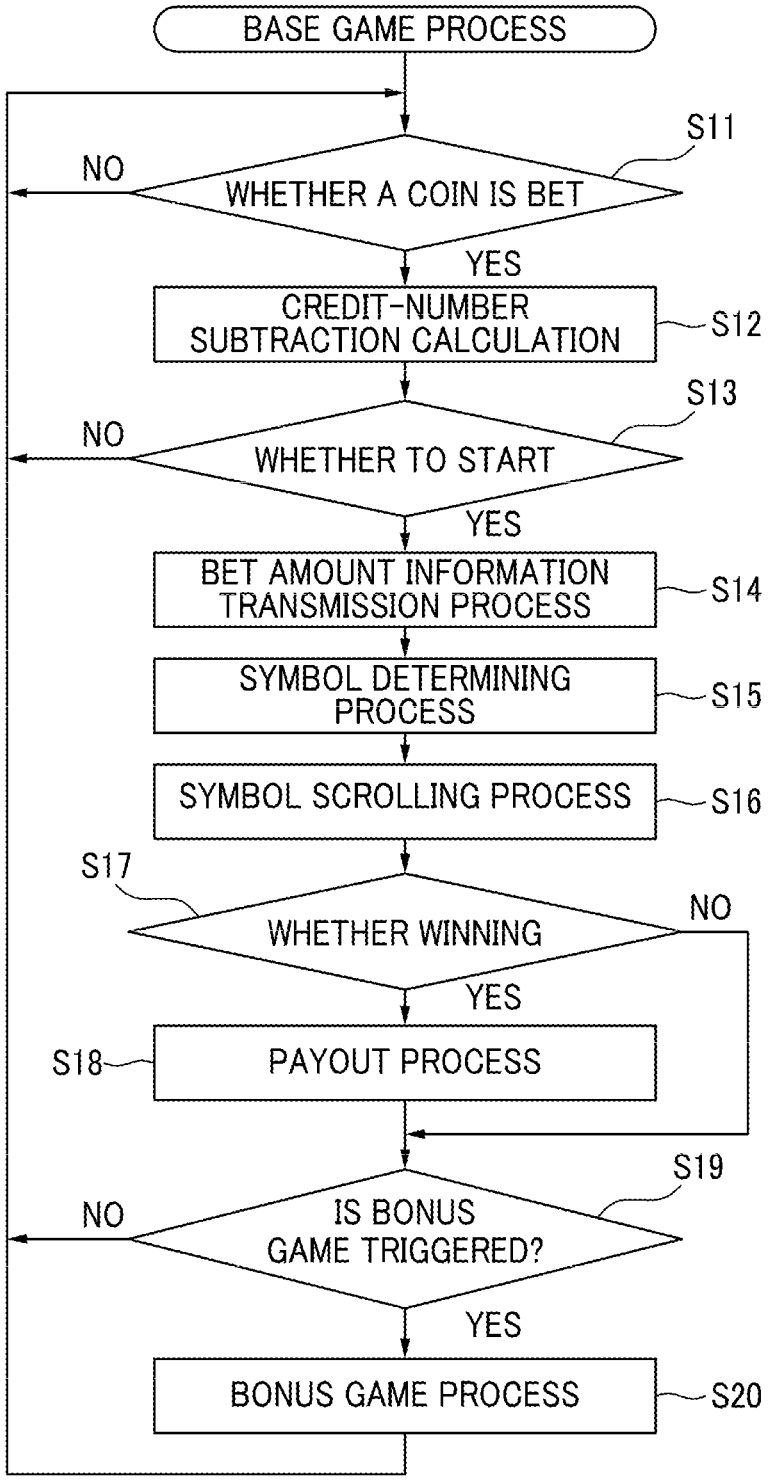
FIG. 18 is a flowchart of a base game processing routine according to an embodiment of the present invention.
Figure 19:
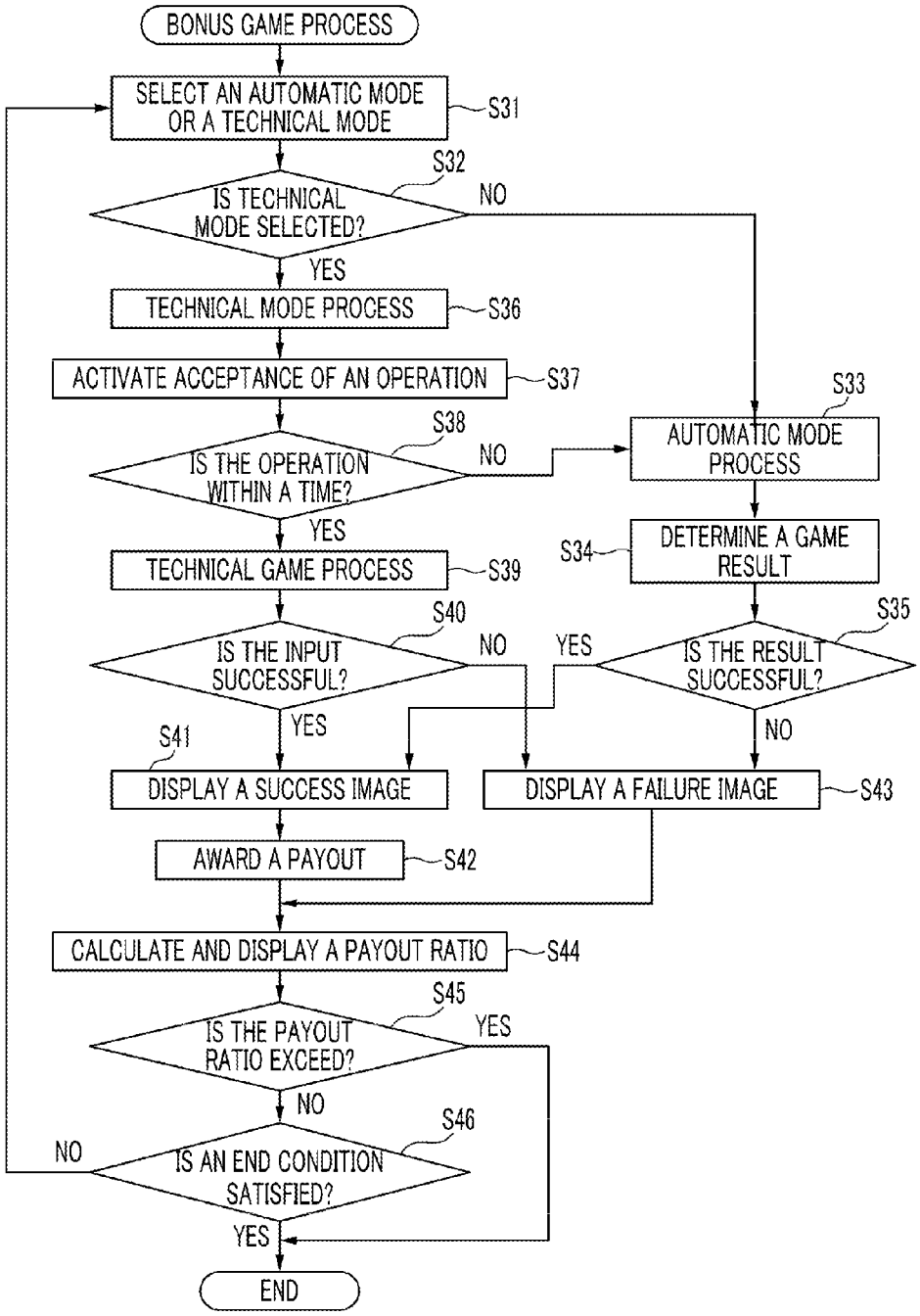
FIG. 19 is a flowchart of a bonus game processing routine according to an embodiment of the present invention.
Figure 20:
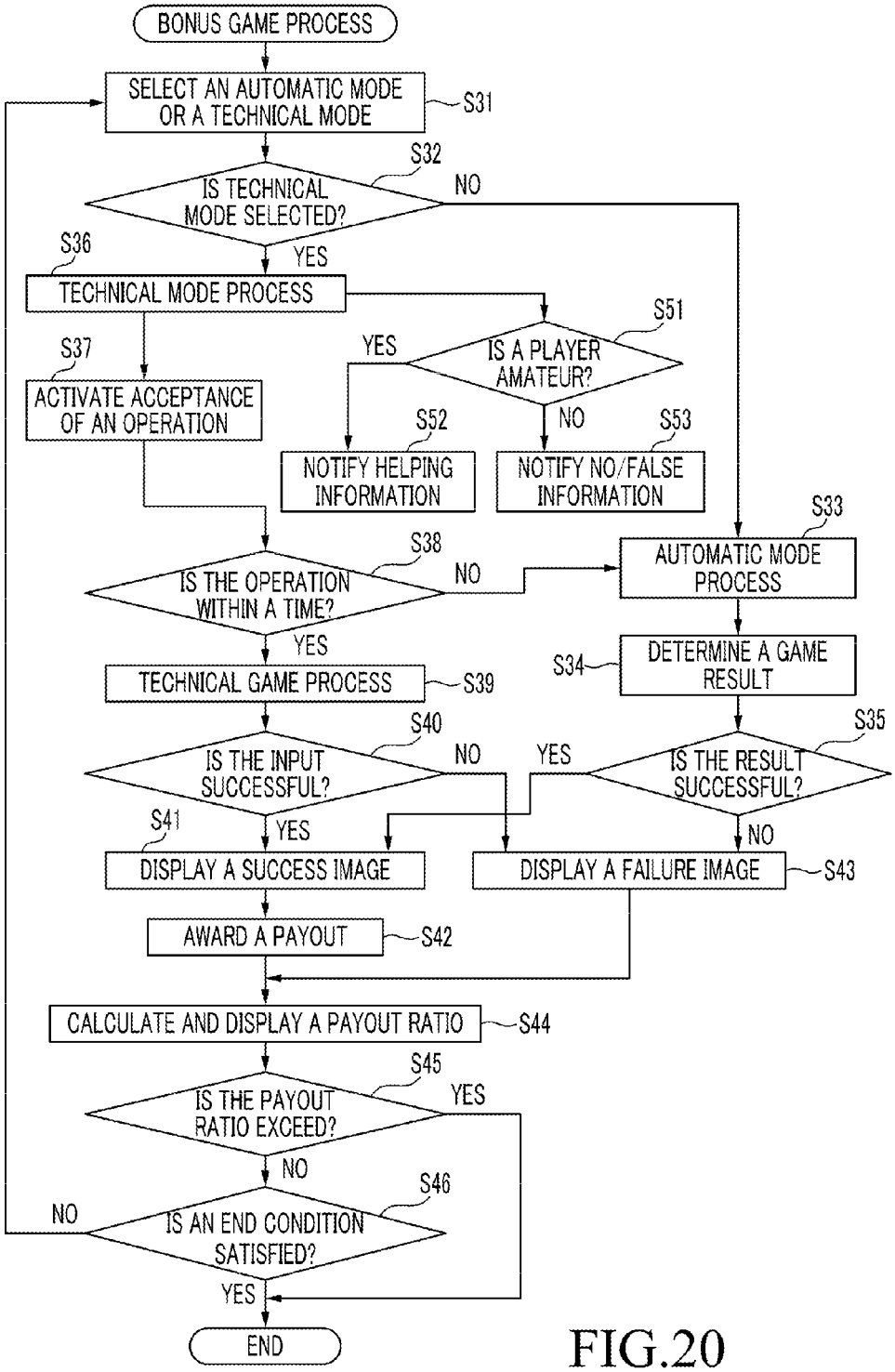
FIG. 20 is a flowchart of a bonus game processing routine according to another embodiment of the present invention.

FIG. 18 is a flowchart of a base game processing routine according to an embodiment of the present invention, FIG. 19 is a flowchart of a bonus game processing routine according to an embodiment of the present invention, and FIG. 20 is a flowchart of a bonus game processing routine according to another embodiment of the present invention.

The main CPU (41 of FIG. 4) of the gaming machine 10 executes the base game processing routine as shown in FIG. 18 to execute the base game.

Referring to FIG. 18, in the base game processing routine, it is determined whether a coin is bet (S11). In this process, it is determined whether an input signal output from the 1-BET switch 26S as the 1-BET button 26 is pushed is received, and whether an input signal outputted from the MAX-BET switch 27S as the MAX-BET button 27 is pushed is received. When the coin is not bet (S11: NO), step S11 is re-executed and the gaming machine is under a standby state until a coin is bet.

In the meantime, when the coin is bet (S11: YES), the credit-value stored in the RAM 43 is reduced corresponding to the number of coins bet (S12). In addition, if the number of coins bet is larger than the credit-value stored in the RAM 43, the process of subtracting the credit-value is not carried out and the process proceeds to step S13. In addition, if the number of coins bet is above the upper limit (50 coins in this embodiment) that can be bet per game, the process of subtracting the credit-value is not carried out and the process proceeds to step S13.

Next, it is determined whether the game is started by the spin button 23 (S13). If it is not started (S13: NO), the process is returned to step S11. In addition, if it is not started (for example, if it is not started and an instruction to end the game is input), the subtraction result from step S12 is canceled.

In the meantime, if the game is started (S13: YES), a BET amount information transmission process is executed (S14). In other words, the BET amount information signal representing the game value bet is transmitted to an external control device of the game arcade provided with the gaming machine 10. The external control device manages the game state of each gaming machine 10 based on the information.

Next, a symbol determining process is executed (S15). In other words, a stop symbol determining program stored in the RAM 43 is executed, so that the symbols 501 that will be stopped in the display window 150 are determined. Accordingly, a combination of symbols to be stopped on the pay line L is determined.

Then, a scroll process of scroll-displaying the symbols 501 in the display 16 is executed (S16). In the scroll process, the symbols 501 are scrolled in the direction indicated by an arrow symbol and then the symbols 501 determined in step S15 are stopped (rearranged) in the display window 150.

Next, on the basis of the combination of symbols 501 rearranged in the display window 150, it is determined whether the combination is a winning combination or not (S17). When it is determined that the combination is a winning combination (S17: YES), the payout process is executed (S18). In other words, if a winning combination is determined, the number of coins to be paid out is calculated on the basis of the prize. In the meantime, in step S17, when it is determined that the combination is not a winning combination (S17: NO), the process in step S19 is executed.

If the payout process in step S18 is executed, the main CPU 41 continues to determine whether a bonus game is triggered (S19). Specifically, the main CPU 41 determines that the bonus game is triggered when special symbols 510 of a number higher than the predetermined number are rearranged on the pay line L, or the special symbols 510 are not arranged in the video reel 153 in the third column and instead a mystery bonus is won through selection. If the bonus game is not started (S19: NO), the process of S11 is executed.

The main CPU 41 of the gaming machine 10 executes the bonus game processing routine as shown in FIG. 12 in the bonus game process (S20 of FIG. 18).

Referring to FIG. 19, the main CPU 41 selects either of the technical mode and the automatic mode (S31) when the bonus game is triggered. The main CPU 41 does not notify the player of the selected mode. The main CPU 41 may generate a random number and select either mode based on the random number and the relationship table whenever the unit game is executed. Alternatively, the main CPU 41 may allocate a corresponding mode to each of the plurality of unit games based on the schedule table. If the selected mode is the automatic mode (S32: No), an automatic game process is executed (S33). That is, the bonus game is executed in the automatic mode. At this time, if the previous bonus game has been executed in the technical mode, the main CPU 41 switches the technical mode to the automatic mode. If the selected mode is the technical mode (S32: Yes), a technical game process is executed (S36). That is, the bonus game is executed in the technical mode. Further, if the previous bonus game has been executed in the automatic mode, the main CPU 41 switches the automatic mode to the technical mode.

When the technical game process is executed (S36), the main CPU 41 activates the acceptance of the operation of the operation unit, for example the control lever (603 of FIG. 2) (S37), and subsequently, it is determined whether there has been an operation of the control lever 603 within the preset processing time (S38). When there has been no operation of the control lever 603 within the preset time (S38: NO), it can be determined that the player does not want to operate the control lever 603 by himself to execute the bonus game, so the main CPU 41 automatically executes the bonus game (S33). That is, the main CPU 41 executes an automatic game process (S33).

When it is determined that there has been an operation of the control lever 603 within the predetermined time (S38: YES), the main CPU 41 executes the technical game process while the player himself operates the control lever 603 (S39). For example, as shown in FIG. 7 to FIG. 10, the player can execute a fishing game through the operation of the control lever 603.

Next, the main CPU 41 determines whether the operation of the control lever 603 is successful (i.e., whether the fishing pole is pulled out at the time capable of catching a fish in the fishing game) in the bonus game (S40).

When the input is successful (S40: YES), the main CPU 41 displays a success image of catching a fish on the display 16 (FIG. 8) (S41), and gives the payout corresponding to the caught fish (S42). If the input fails (i.e., the fish is not caught) (S40: NO), the main CPU 41 displays a failure image representing failure to catch a fish on the display 16 (S43).

Subsequently, the main CPU 41 may calculate a payout ratio corresponding to an operation result (success or failure) of the control lever 603, store the calculation result in a corresponding area in the RAM 43, and display the calculation result on the display 16 (S44). Specifically, a ratio of the changed payout ratio in the bonus game (input success or input failure) to the payout ratio set in the base game is displayed in numbers. The payout ratio refers to the ratio of the number of coins to be paid out (the payout) to the number of inserted coins. In this embodiment, a coin has to be inserted (bet) in the base game, but in the bonus game, no coin needs to be inserted (bet). Therefore, if the input operation of the control lever 603 is successful, as the number of coins inserted in the base game is thus far unchanged, the ratio of the number of coins to be paid out in the bonus game to the number of coins, i.e., the payout ratio (the payout ratio of the bonus game) is increased, and if the operation fails, the payout ratio is not changed. Further, the target payout ratio that is preset in the base game and the target payout ratio (allowable payout ratio) in the bonus game are separately stored in corresponding areas in the RAM 43.

The main CPU 41 may determine whether the calculated payout ratio exceeds the allowable payout ratio that is preset in the RAM 43 (S45). The allowable payout ratio is determined in consideration of the interests of the game arcade, and is set to a value that is higher than the fixed payout ratio (for example, 80%, 84%, or 88%) that is preset in the base game and lower than 100%. The allowable payout ratio is set such that when the value is exceeded the bonus game is ended, thereby providing a higher payout ratio than that in the base game while still preserving the interests of the game arcade.

When determining that the calculated payout ratio does not exceed the allowable payout ratio (S45: NO), the main CPU 41 determines whether an end condition of the bonus game is satisfied (S46). In this embodiment, the end condition uses a determination reference of whether the time from the beginning of the bonus game reaches the time that is preset in the RAM 43, but the present invention is not limited thereto. For example, other conditions such as the number of unit games executed in the bonus game can be used as reference.

When the end condition is not satisfied (S46: NO), the main CPU 41 returns to the process of S31 to continue the bonus game. In step S31, the main CPU selects either mode based on the relationship table again, or uses a mode that is allocated in advance based on the schedule table. On the other hand, when the end condition is satisfied (S46: YES), or when it is determined that the payout ratio exceeds the allowable payout ratio (S45: YES), the main CPU 41 ends the bonus game.

In the meantime, if the gaming machine 10 does not calculate the payout ratio again or does not inform the player of the changed payout ratio, the process regarding the payout ratio (S44 and S45) may be omitted in the bonus game processing routine.

When the automatic game process is executed (S33), the main CPU 41 automatically executes the bonus game and automatically determines the result of the game (S34). For example, as shown in FIG. 7 to FIG. 10, the main CPU 41 determines whether a fish is caught or not in the fishing game, and what kind of fish is caught when the fish is caught. When the result is successful (S35: YES), the main CPU 41 performs the process in S41. If the result fails (S35: NO), the main CPU 41 performs the process in S43.

Referring to FIG. 20, the main CPU 41 performs the process beginning from step S31, as described with reference to FIG. 19, when the bonus game is triggered.

In the technical game process, the main CPU 41 further determines whether the player is an expert or an amateur at the bonus game based on the player history information stored in the storage device (S51). If the player is an amateur at the bonus game, the main CPU 41 notifies the player of helping information (S52) when the player performs the operation of the control lever 603 (S38). The helping information is information for helping the player to succeed in the bonus game. If the player is an expert of at bonus game, the main CPU 41 notifies the player of no information or notifies the player of false information (S53) when the player performs the operation of the control lever 603 (S38). The false information is information for preventing the player from succeeding in the game in the technical mode.

In the automatic mode process, the main CPU 41 may notify an amateur player of the helping information and notify an expert player of no information or the false information since the player does not know whether the current bonus game is executed in the technical mode or the automatic mode.

As described above, according to embodiments of the present invention, the gaming machine can award a certain payout to the player in the bonus game regardless of the player's skill.

Embodiments of the present invention can also be embodied as a computer readable program on a computer-readable recording medium. The computer readable recording medium is any data storage device that can store data that can be read thereafter by a computer. Examples of the computer readable recording medium include ROMs, RAMs, CD-ROMs, magnetic tapes, floppy disks, and optical data storage devices. The computer readable recording medium can also be distributed over a network coupled computer system so that the computer readable code is stored and executed in a distributed fashion.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A gaming machine, comprising:

a display configured to display a plurality of symbols in a base game, to display a bonus game image in a bonus game, and to display an award according to a game result;

an operating unit configured to accept an operation of a player;

a controller configured to execute the base game, to award a payout according to a game result of the base game to the player, to trigger the bonus game including a plurality of unit games when a combination of the symbols in the base game satisfies a predetermined condition, to select any one mode for each unit game among a plurality of modes including an automatic mode and a technical mode of each unit game, wherein the automatic mode is a mode in which the controller automatically determines a game result of the bonus game, and the technical mode is a mode in which the game result of the bonus game is determined by the operation of the player, to execute each unit game in a corresponding selected mode, and to award a payout according to a game result of the bonus game to the player; and a storage device configured to store a relationship table representing a relationship between each of the plurality of modes and a range of random numbers, wherein the controller is further configured to generate a random number for each unit game, and to select any one mode for each unit game based on the random number for a corresponding unit game and the relationship table.

2. The gaming machine of claim 1, wherein the controller is further configured to not notify the player of the selected mode.

3. The gaming machine of claim 1, wherein the controller is further configured to randomly select any one mode for each unit game whenever each unit game is executed.

4. The gaming machine of claim 1, wherein the controller is further configured to generate a random number for each unit game whenever each unit game is executed, and to select any one mode for each unit game based on the random number.

5. The gaming machine of claim 1, wherein the controller is further configured to change a game state of the bonus game based on a parameter among a plurality of game states, the parameter including a number of games that the player has played or a time during which the player has played games, wherein the range of random numbers corresponding to the technical mode for a first game state is different from the range of random numbers corresponding to the technical mode for a second game state.

6. The gaming machine of claim 1, wherein the controller is further configured to allocate any one mode to each of the plurality of unit games when the bonus game is triggered.

7. The gaming machine of claim 6, further comprising a storage device configured to store a schedule table representing a relationship between the plurality of unit games and any mode allocated to each unit game, wherein the controller is further configured to allocate any one mode to each of the plurality of unit games based on the schedule table.

8. The gaming machine of claim 7, wherein the controller is further configured to change a game state of the bonus game based on a parameter among a plurality of game states, the parameter including a number of games that the player has played or a time during which the player has played games, wherein a number of unit games allocated to the technical mode for a first game state is different from a number of unit games allocated to the technical mode for a second game state.

9. The gaming machine of claim 1, wherein the controller is further configured to determine a success rate of bonus games according to the technical mode based on a game history of the player, and to notify the player of information for helping the player to succeed in a game according to the technical mode when the game success rate of the player is lower than a threshold.

10. The gaming machine of claim 1, wherein the controller is further configured to determine a success rate of bonus games according to the technical mode based on a game history of the player, and to notify the player of information for preventing the player from succeeding in a game according to the technical mode when the success rate of the player is higher than a threshold.

11. The gaming machine of claim 1, wherein the controller is further configured to determine that the player succeeds in the unit game of the technical mode when the operating unit accepts the operation of the player at a proper time.

12. The gaming machine of claim 1, wherein the controller is further configured to randomly determine whether the player succeeds in the unit game of the automatic mode regardless of the operation of the player.

13. A gaming machine, comprising:

a display configured to display a plurality of symbols in a base game, to display a bonus game image in a bonus game, and to display an award according to a game result;

an operating unit configured to accept an operation of a player;

a controller configured to execute the base game, to award a payout according to a game result of the base game to the player, to trigger the bonus game including a plurality of unit games when a combination of the symbols in the base game satisfies a predetermined condition, to execute at least one unit game of a first mode, to switch the first mode to a second mode without notifying the player of a switch, and to execute at least one unit game of the second mode; and a storage device configured to store a relationship table representing a relationship between each of the plurality of modes and a range of random numbers, wherein the first mode is one of an automatic mode and a technical mode, and the second mode is the other of the automatic mode and the technical mode, and wherein the automatic mode is a mode in which the controller automatically determines a game result of the bonus game, and the technical mode is a mode in which the game result of the bonus game is determined by the operation of the player, wherein the controller is further configured to generate a random number for each unit game, to select any one mode for each unit game based on the random number for a corresponding unit game and the relationship table, and to determine whether to switch the first mode to the second mode based on the selected mode for each unit game.

14. The gaming machine of claim 13, wherein the controller is further configured to randomly select any one mode for each unit game whenever each unit game is executed, and to determine whether to switch the first mode to the second mode based on the selected mode for each unit game.

15. The gaming machine of claim 13, wherein the controller is further configured to allocate any one mode to each of the plurality of unit games when the bonus game is triggered, and to determine whether to switch the first mode to the second mode based on the allocated mode for each unit game.

16. The gaming machine of claim 15, further comprising a storage device configured to store a schedule table representing a relationship between the plurality of unit games and any mode allocated to each unit game, wherein the controller is further configured to allocate any one mode to each of the plurality of unit games based on the schedule table.

17. A non-transitory computer-readable recording medium storing a program to cause a computer to execute a game operating method, the method comprising:

executing a base game;

awarding a payout according to a game result of the base game to a player;

triggering a bonus game including a plurality of unit games when the game result of the base game satisfies a predetermined condition;

selecting any one mode for each unit game among a plurality of modes including an automatic mode and a technical mode of each unit game, wherein the automatic mode is a mode in which the computer automatically determines a game result of the bonus game, and the technical mode is a mode in which the game result of the bonus game is determined by the operation of the player;

executing each unit game in a corresponding selected mode; and awarding a payout according to a game result of the bonus game to the player, wherein selecting the any one mode comprises storing a relationship table representing a relationship between each of the plurality of modes and a range of random numbers, generating a random number for each unit game, and selecting the any one mode for each unit game based on the random number for a corresponding unit game and the relationship table.

* * * * *